US005294958A

United States Patent [19]

Isobe et al.

[11] Patent Number: 5,294,958

[45] Date of Patent: Mar. 15, 1994

[54] IMAGE FORMING APPARATUS HAVING PHOTOCONDUCTOR DRUM AND FUSER INDEPENDENTLY OPERABLE IN TIMING

[75] Inventors: Minoru Isobe; Eisho Sudoh, both of Tokyo, Japan

[73] Assignee: Oki Electric Industry Co., Ltd., Tokyo, Japan

[21] Appl. No.: 644,537

[22] Filed: Jan. 23, 1991

[30] Foreign Application Priority Data

Jan. 23, 1990 [JP] Japan ..... 2-11692

[51] Int. Cl.[5] ..... G03G 21/00

[52] U.S. Cl. ..... 355/208; 271/259; 271/265; 355/203; 355/211; 355/282; 355/309

[58] Field of Search ..... 355/203, 205, 206, 207, 355/208, 282, 211, 218, 271, 308, 309, 317, 235; 271/265, 259

[56] References Cited

U.S. PATENT DOCUMENTS

| | | | |
|---|---|---|---|
| 4,260,236 | 4/1981 | Tsuda et al. | 355/308 X |
| 4,627,711 | 12/1986 | Schroh | 355/208 |
| 4,719,491 | 1/1988 | Katoh et al. | 355/235 |
| 4,733,281 | 3/1988 | Yoshinaga et al. | 355/309 X |
| 4,743,947 | 5/1988 | Yamamoto | 355/218 |
| 4,812,876 | 3/1989 | Nawata | 355/206 |
| 4,937,622 | 6/1990 | Makiura | 355/206 |

FOREIGN PATENT DOCUMENTS

| | | | |
|---|---|---|---|
| 0295901 | 12/1988 | European Pat. Off. . | |
| 0363686 | 4/1990 | European Pat. Off. | 355/203 |
| 60-113578 | 6/1985 | Japan | 355/207 |
| 61-2165 | 1/1986 | Japan | 355/207 |
| 61-94079 | 5/1986 | Japan | 355/206 |
| 2-79057 | 3/1990 | Japan | 355/208 |

*Primary Examiner*—A. T. Grimley
*Assistant Examiner*—Shuk Y. Lee
*Attorney, Agent, or Firm*—Spencer, Frank & Schneider

[57] ABSTRACT

An image forming apparatus includes a controller for controlling at least a photoconductor drum and a fuser to operate independently of each other. In such an apparatus, at least one of the photoconductor drum and the fuser is provided with an electrical or mechanical member, such as a clutch for selectively coupling a driving system and a rotary member, which is operative independently, and the controller provides such a control that the electrical or mechanical members of the photoconductor drum and the fuser are responsive to signals applied thereto to start or stop the operations independently in timing, respectively.

20 Claims, 24 Drawing Sheets

IMAGE FORMING APPARATUS HAVING PHOTOCONDUCTOR DRUM AND FUSER INDEPENDENTLY OPERABLE IN TIMING

BACKGROUND OF THE INVENTION

1. Field of the Invention

The present invention relates to an image forming apparatus, and more particularly to the apparatus wherein at least a photoconductor drum and a fuser may be operative independently of each other.

2. Description of the Prior Art

Hitherto, in an image forming apparatus such as an electrophotographic printer, an electrically charged photoconductor drum is illuminated with a light source to form an electrostatic latent image on a surface thereof, a developing is performed upon adhesion of a toner to the electrostatic latent image, and then the thus obtained toner image is transferred to a recording material.

FIG. 9 shows a conceptual view for explanation of an electrophotographic process in the image forming apparatus. The electrophotographic process comprises a photoconductor drum 11 having a photoconductive surface on an outer periphery thereof, an electrostatic charger 12 for uniformly charging the photoconductor drum 11, a light emitting diode array or exposure 13 for forming an electrostatic latent image corresponding to image data on the photoconductive surface, a developing unit 14 for providing electrostatic adhesion of a toner to the electrostatic latent image, a transfer unit 15 for transferring a toner image to a sheet of paper, a fuser 16 for heating and fusing the transferred toner image to penetrate through fibers of the paper, and a cleaner 17 for removing residual electrostatic charge and toner on the photoconductive surface.

During one rotation of the photoconductor drum 11, the respective processes of charging, exposing, developing, transferring, discharging and cleaning are carried out in the order named, and the fixing process is performed on a printing paper.

The developing unit 14 varies in its structure depending on a toner to be used, which consists of a single component or two components. In case of use of a toner consisting of a single component, the developing unit 14 comprises a toner replenishment roller for replenishing the toner, a developing roller for providing adhesion of the toner to the electrostatic latent image on the photoconductor drum 11 to form a toner visible image and a blade for providing a unity of thickness of the toner adhered to the developing roller.

The toner replenishment roller is rotated in conjunction with the developing roller in a slidable relation. Thus, there is generated frictional electrostatic charge between the developing roller and the toner, so that a surface of the developing roller is charged with the positive electricity (+) and the toner is charged with the negative electricity (−). As a result, the toner adheres to the developing roller. The toner adhered to the developing roller is deleted by the blade so that a thin film of the toner is formed on the surface of the developing roller.

Thus, the toner adheres to an exposure portion of the photoconductor drum 11 at a contact portion of the photoconductor drum 11 and the developing roller, so that the electrostatic latent image is visualized. As stated above, charging of the toner is performed by the frictional electrostatic charge. This brings uneven density in polarity of charge. As a result, there would occur so-called "background" wherein a toner adheres to a portion which is to be the original white part, and a scatter of the toner, thereby inviting deterioration of a quality of an image and waste of the toner.

After completion of the transfer process, residual toner, which has remained on the photoconductive surface of the photoconductor drum 11 without being transferred, is removed by a cleaning brush or a cleaning blade of the cleaner 17, so that the photoconductive surface is in cleaned. Since the cleaner 17 is contact with the photoconductive surface, it has a strong effect on the span of life of the photoconductor drum 11.

Generally, the fuser 16 employs a pressure roll fixing scheme, and comprises a roller self containing a heater subjected to a Teflon coating process, a pressure roller consisting of a silicone rubber, a guide for preventing a paper after fixing from being rolled by the heater roller, and so on.

The span of life of the fuser 16 is shortened by an injury to the Teflon coating owing to such an involvement that the fused toner penetrates between the heater roller and the guide, or exhaustion of the Teflon coating and the silicone rubber owing to the friction at a paper running.

Thus, the amount of consumed toner, the span of life of the photoconductor drum 11 and the span of life of the fuser 16 are determined in accordance with the number of rotations in each of which a series of processes are carried out. Consequently, it is necessary to reduce the useless operations as much as possible.

FIG. 10 shows a schematic representation of the conventional image forming apparatus. In the figure, a printing apparatus 1 includes in control unit 2 an external connection interface 3 constructed with a Centronics Interface and so on. Printing data from a terminal unit 9 are entered through the external connection interface 3.

The control unit 2 is provided with, in addition to the external connection interface 3, a receiving buffer 4, a microprocessor 5, a font memory 6, an image memory 7 and a printer interface 8.

The control unit 2 is connected through the printer interface 8 to a printer unit 10. The printer unit 10 is provided with, as stated above, the photoconductor drum 11 having a photoconductive surface on an outer periphery thereof, the electrostatic charger 12 for uniformly charging the photoconductor drum 11, the light emitting diode array (exposure) 13 for forming an electrostatic latent image corresponding to image data on the photoconductive surface, the developing unit 14 for providing electrostatic adhesion of a toner to the electrostatic latent image, the transfer unit 15 for transferring a toner image to a printing paper, the fuser 16 for heating and fusing the transferred toner image to penetrate through fibers of the printing paper, and a cleaner 17 for removing residual electrostatic charge and toner on the photoconductive surface.

Further, the printer unit 10 is provided with a printing paper feeding unit 18 for automatically feeding a fixed type of printing paper, a hopping roller 19 for supplying the printing paper from the printing paper feeding unit 18, a hopping roller clutch 20, a paper feed sensor 22 for sensing the printing paper supplied from the printing paper feeding unit 18, a registering roller 23 for transporting the printing paper, a delivery roller 25 for delivering the printed printing paper to a delivery unit 27, a paper output sensor 24 for sensing delivery of the printing paper, a main drive motor 21, which may be a stepping motor, for paper feed, paper transfer, driving of the photoconductor drum 11 and so on, power transmission means 30 such as a transmission gear and a transmission belt for power transmission, and printing mechanism control 26 for controlling the whole mechanism of printer unit 10 and performing communication with the control unit 2.

The control unit 2 and printer unit 10 are connected through a serial interface 28 for performing communication therebetween and a video interface 29 for transferring and controlling printing data formed with dot image data.

In the printing apparatus 1, when the printing data is entered from a host computer, not shown, through the terminal unit 9 and the external connection interface unit 3, the data is taken in the receiving buffer 4.

Next, microprocessor 5 reads character codes included in the printing data, and generates dot image data for printing referring to the font memory 6.

The dot image data for printing is edited, for example, as dot image data for printing corresponding to a page of printing paper, and then written into the image memory 7.

In case of transmission of the image data from the host computer, not shown, a dot image developing processing is performed at the host computer side. Thus, not only does it take time until a transmission starts, but the data transmission takes time, since the image data is of a large capacity. However, in this case, it is sufficient for the microprocessor 5 to write the received image data into a predetermined address of the image memory 7 as it is.

On the other hand, in case of a business graph printing and so on, data are transmits from the host computer in form of a graphic command. Thus, the microprocessor 5 performs an editing operation for the data and then writes the edited data into a predetermined address of the image memory 7. In this case, the microprocessor 5 performs a bit map developing processing, and thus it takes much time to write a page of dot image data into the image memory 7.

Thus, when the dot image data for printing has been completed, a printing paper is transferred from the printing paper feeding unit 18 toward the the transfer unit 15. During transfer of the printing paper, the dot image data for printing drives the light emitting diode array 13 to form the latent image on the outer periphery of the photoconductor drum 11. When the photoconductor drum 11 rotated in the direction of arrow 111, the latent image is developed by the developing unit 14 and the developed image is transferred to the printing paper in the transfer unit 15. The printing paper is fixed by the fuser 16 and then discharged toward the carrying out unit 27. Thus, printed on the printing paper is information based on printing data received from the host computer.

Next, the conventional image forming apparatus will be explained more in detail, referring to FIGS. 11–14, hereinafter.

FIG. 11 shows an operational flow of a control unit of the conventional image forming apparatus. FIG. 12 is an operational flow chart of a printing unit of the conventional image forming apparatus. FIG. 13 is a time chart of the conventional image forming apparatus, and FIG. 14 is a diagram used for the explanation of the printing unit of the conventional image forming apparatus.

Now referring to FIG. 11, in steps S1 and S2, first, upon receipt of printing data transmitted from the host computer, the control unit 2 performs a page of receiving processing. In steps S3 and S4, an editing processing is performed to form a page of dot image data. In steps S6–S7, a paper feed ready signal, which is transmitted from the printer unit 10 through the serial interface 28, is discriminated, and if possible, a print start command is transmitted through the serial interface 28 in a timing shown in FIG. 13(c) to start a real printing processing.

Next, referring to FIG. 12A, in steps S10–S12, the printing mechanism control 26 determines, upon receipt of the print start command, as to whether the printer unit 10 is in condition of a rest, and if in the rest condition, there starts a printing preliminary operation for performing a real printing operation. In the printing preliminary operation. the main drive motor 21 turns on, and the photoconductor drum 11, the registering roller 23, the fuser 16 and the delivery roller 25 are driven by coupling means such as power transmission means 30, for example, a transmission gear and belt, for power transmission (refer to FIG. 14A). Thus, there are provided the preliminary operations such as a primary charge on the photoconductor drum 11, a toner charge by toner agitating in the developing unit 14, and providing a constant fusing temperature. Such a preliminary operation is carried out during (time TR) one to two revolutions of the photoconductor drum 11.

In step S13, the printing mechanism control 26 turns on the hopping roller clutch 20 and connects the power of the main drive motor 21 to the hopping roller 19 so as to start taking out of the printing paper 31 from the printing paper feeding unit 18 (refer to FIG. 14B).

In step S14, the printing paper 31 taken out from the printing paper feeding unit 18 runs on a paper carrying path, the paper feed sensor 22 informs the printing mechanism control 26 of a paper feed sensor turn-on signal at the time (time TH) when the paper feed sensor 22 detects the paper presence (refer to FIG. 14C).

In steps S15–S16, when the printing mechanism control 26 recognizes the fact that the printing paper 31 is detected by the paper feed sensor 22 and be transferred by the registering roller 23, the hopping roller clutch 20 is turned on to provide conditions for allowance of a real printing.

In step S17, at the time point (time TW) when a latent image is formed by the light emitting diode array 13, a toner image is formed by the developing unit 14, and there is provided such a relation that a distance that a distance l1 until the portion of the surface of photoconductor drum 11, on which the toner image is formed, reaches the transfer unit 15 for transferring the toner image to the printing paper, equals a remaining carrying distance l1 for the printing paper until it reaches the transfer unit 15. The printing mechanism control 26 starts a real printing processing to request the control unit 2 to send the dot image data for printing through the video interface 29 (refer to FIG. 14D). When the real printing processing starts, the dot image data for printing is transmitted from the control unit through the video interface 29 and the light emitting diode array 13 is driven, so that the latent image is formed on the outer periphery of the photoconductor drum 11. The photoconductor drum 11 rotates in direction of arrow 111 in synchronism with the paper transfer, the latent image is developed by the developing unit 14 to form the toner image, and the toner image is transferred to the printing paper 31 in the transfer unit 15 (refer to FIG. 14E).

In steps S18–S20, while a series of operations from the latent image formation to the transfer are sequentially performed, the printing mechanism control 26 monitors a running condition of the printing paper 31 and informs the control unit 2 of a next page feed ready signal through the serial interface 28, upon detection of turn on of the paper output sensor 24 and turn off of the paper feed sensor 22 (refer to FIG. 14F).

In steps S21–S22, when the printing mechanism control 26 detects turn on of the paper output sensor 24, the control unit 2 transmits a printing start command for a next page to the printing mechanism control 26 through the serial interface 28, if an editing processing for the next page printing data has been completed.

In steps S23–S24, the printing mechanism control 26 starts a next page paper feed processing, upon receipt of the printing start command for the next page, and transmits a paper feed ready signal off to the control unit 2.

In a case where no printing data for a next page exists in the control unit 2, or in a case where the editing processing has not completed in the control unit 2, there is provided a discharge waiting condition for the printing paper in course of the real printing processing. When the transfer of the processed page has been completed (refer to FIG. 14G), and the printing paper is moved for distance 12 from the transfer unit 15, in other word, the photoconductor drum 11 moves for distance 12 from the transfer unit 15 to the cleaner 17, residual electrostatic charge and toner on a surface of the photoconductor drum 11 are removed by the cleaner 17, and the cleaning processing for the page is terminated (refer to FIG. 14H). The printing paper 31 after transfer is fixed by the fuser 16 (refer to FIG. 14I). When the page has passed through the paper output sensor 24 (refer to FIG. 14I), the printing mechanism control 26 detects turn off of the paper output sensor 24 in step S21 and turns off the main drive motor 21 in step S25 so as to terminate the real printing processing. During a period of time until the main drive motor 21 is turned off, the photoconductor drum 11, the developing unit 14, the registering roller 23, the fuser 16 and the delivery roller 25, which are coupled with the main drive motor 21 through the belt, gear and so on, continue to be driven.

In the image forming apparatus arranged as stated above, however, the printing paper feeding unit 18, the photoconductor drum 11, the developing unit 14, the registering roller 23, the delivery roller 25 and so on are driven by a single power source, and thus those elements are simultaneously driving-started and driving-stopped. That is, according to the conventional image forming apparatus as stated above, it would be impossible to perform, only at the necessary time, the charging for the photoconductor drum 11, the charging for the toner within the developing unit 14, the developing operation, the cleaning operation, and the fixing operation.

It is necessary for the photoconductor drum 11 and the developing unit 14 to provide time TR needed for a preliminary operation (performed only when one page printing), printing paper transfer time TW until start of print data writing, printing paper transfer time T11 from a point of time of writing of the printing data until the transfer, and printing paper passage time TP, but unnecessary to provide the other times such as printing paper feeding time TH and discharge time (given by subtraction of cleaning time from TS). Reversely, it is unnecessary for the fuser 16 to provide those times TR, TH, TW and T11. Particularly, in case of one page printing/one job, or in a case where receiving processing and editing processing times are long, needless operation would be performed.

Further, in a case where there is provided a long distance for the printing paper transfer from the printing paper feeding unit 18 to the photoconductor drum 11 as an image forming section, or in a case where there is provided a long distance for the printing paper transfer from the photoconductor drum 11 or the fuser 16 to the discharge section, and so on, life of the photoconductor drum 11 and the fuser 16 would be shortened, and further increases the amount of consumed toner.

SUMMARY OF THE INVENTION

It is therefore an object of the present invention to provide an image forming apparatus in which the driving means of a printing paper feed unit, the driving means of a photoconductor drum and the developing unit, and the driving means of a fuser may be operative independently of each other. This feature makes it possible to reduce the operation time for the photoconductor drum and the developing unit, to avoid shortening of the span of life thereof, and to advantageously reduce the amount of the toner to be consumed.

In accordance with a preferred embodiment of the present invention, there is disclosed an image forming apparatus including a controller for causing at least a photoconductor drum and a fuser to operate independently of each other. In such an apparatus, at least one of the photoconductor drum and the fuser is provided with an electrical or mechanical member, such as a clutch for selectively coupling a driving system and a rotary member, which is operative independently, and the controller provides such a control that the mechanical members of the photoconductor drum and the fuser are responsive to signals applied thereto to start or stop the operations independently in timing, respectively.

In such an apparatus, a paper feed sensor for detecting a presence or absence of the printing paper is provided between the printing paper feed unit and a registering roller, and while the photoconductor drum still stops the rotation when the printing paper is taken out from the printing paper feed unit, it starts the rotation when the paper feed sensor is turned on. Further, a platen sensor for detecting a presence or absence of the printing paper is provided between the transfer unit and said fuser, and the photoconductor drum stops the rotation when the printing paper reaches the fuser and then the platen sensor is turned off.

Further, in such apparatus, the fuser starts operation when said platen sensor is turned on while the printing paper passes through the transfer unit and reaches the fuser. A paper output sensor for detecting a presence or absence of the printing paper is provided between the fuser and a delivery roller, and the fuser stops the operation when said paper output sensor is turned off while the printing paper passes through the fuser and goes to a delivery roller.

BRIEF DESCRIPTION OF THE DRAWINGS

The objects and features of the present invention will become more apparent from the consideration of the following detailed description taken in conjunction with the accompanying drawings in which:

FIGS. 3A, 3A-1, 3A-2, 3B, 3C, 3C-1 and 3C-2 are operational flow charts of a printing unit of the image forming apparatus according to the present invention. FIGS. 3A-1 and 3A-2, and 3C-1 and 3C-2 being combined as shown in FIGS. 3A and 3C, respectively;

DESCRIPTION OF THE PREFERRED EMBODIMENTS

Figure 1:
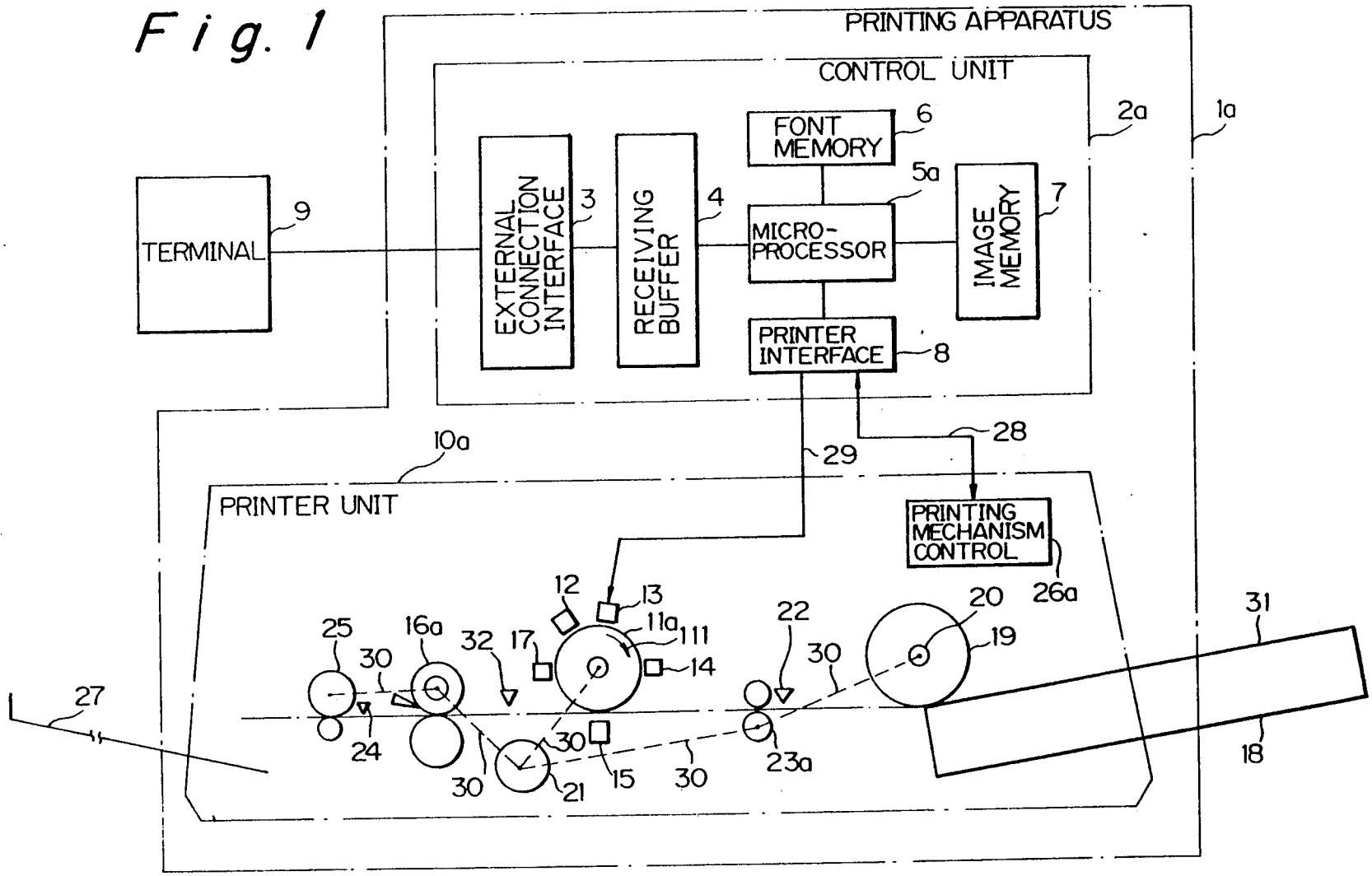
FIG. 1 is a schematic representation of an image forming apparatus according to a first embodiment of the present invention.

The preferred embodiments of an image forming apparatus of the invention will be described with reference to the drawings in detail. FIG. 1 shows a schematic representation of an image forming apparatus according to a first embodiment of the present invention. In the following figures, the parts are denoted by the same reference numbers as those of the conventional image forming apparatus, and the explanation thereof is omitted.

In the figure, a printing apparatus 1*a* of an image forming apparatus according to the present invention comprises a control unit 2*a* and a printer unit 10*a*. The control unit 2*a* is provided with a microprocessor 5*a* which is different from the conventional one in a program processing. The printer unit 10*a* is provided with a printing mechanism control 26*a* for performing a program processing and a control which are different from the conventional ones with respect to an electrophotographic process control such as a timing for taking out the printing paper or sheet 31 from the printing paper feeding unit 18, feeding and charging of the printing paper, exposure, developing, transfer, fixing, cleaning and so on.

Registering roller 23*a* for feeding of the printing paper, a photoconductor drum 11*a* for printing and a fuser 16*a* are provided with electrical or mechanical clutches for driving those independently of each other, respectively. In order to control a driving timing of the photoconductor drum 11*a* and the fuser 16*a*, there is provided a platen sensor 32 for sensing a paper or sheet feeding condition.

Figure 2:
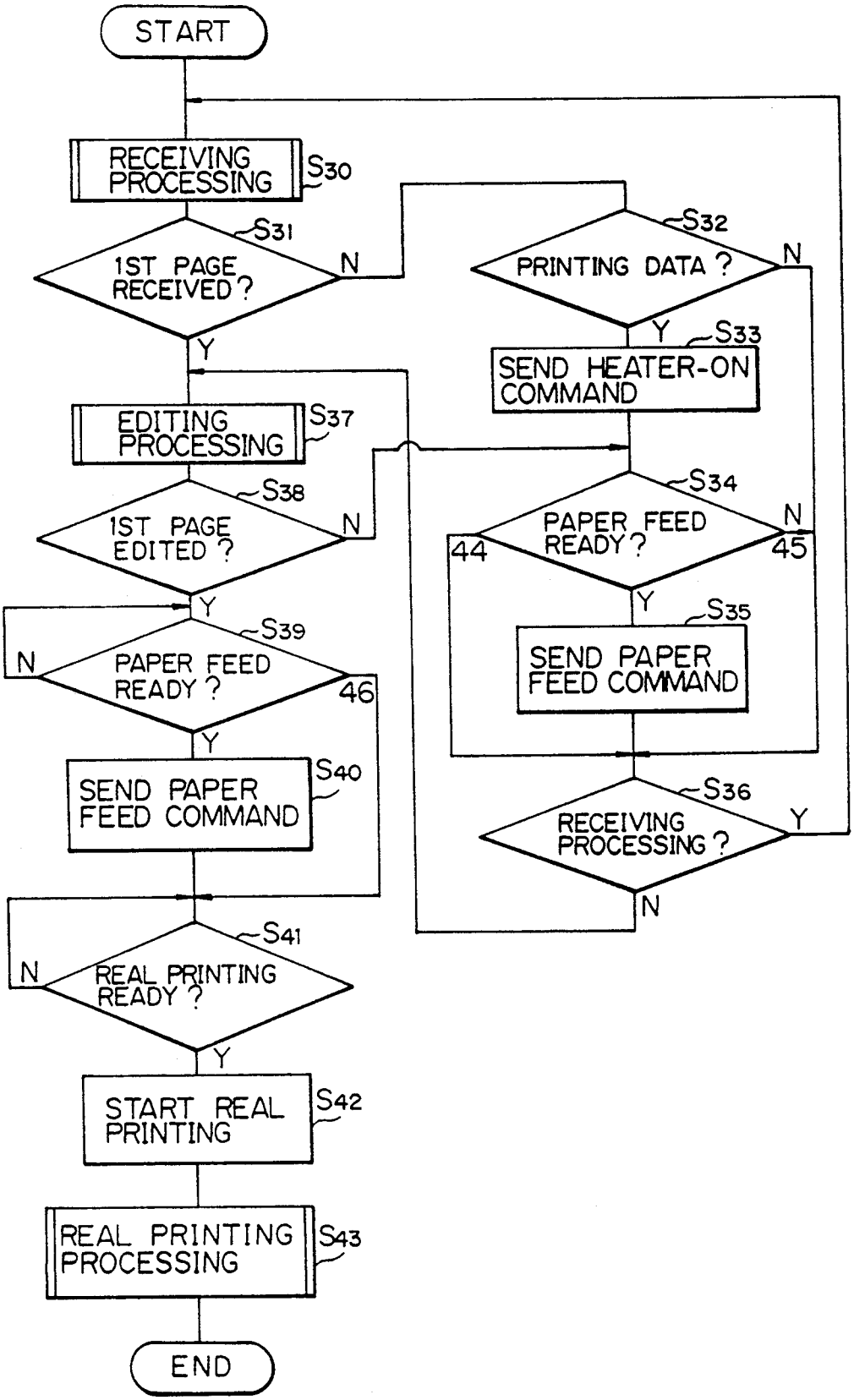
FIG. 2 shows an operational flow of a control unit of the image forming apparatus according to the present invention.
Figures 1, 2, 3A:
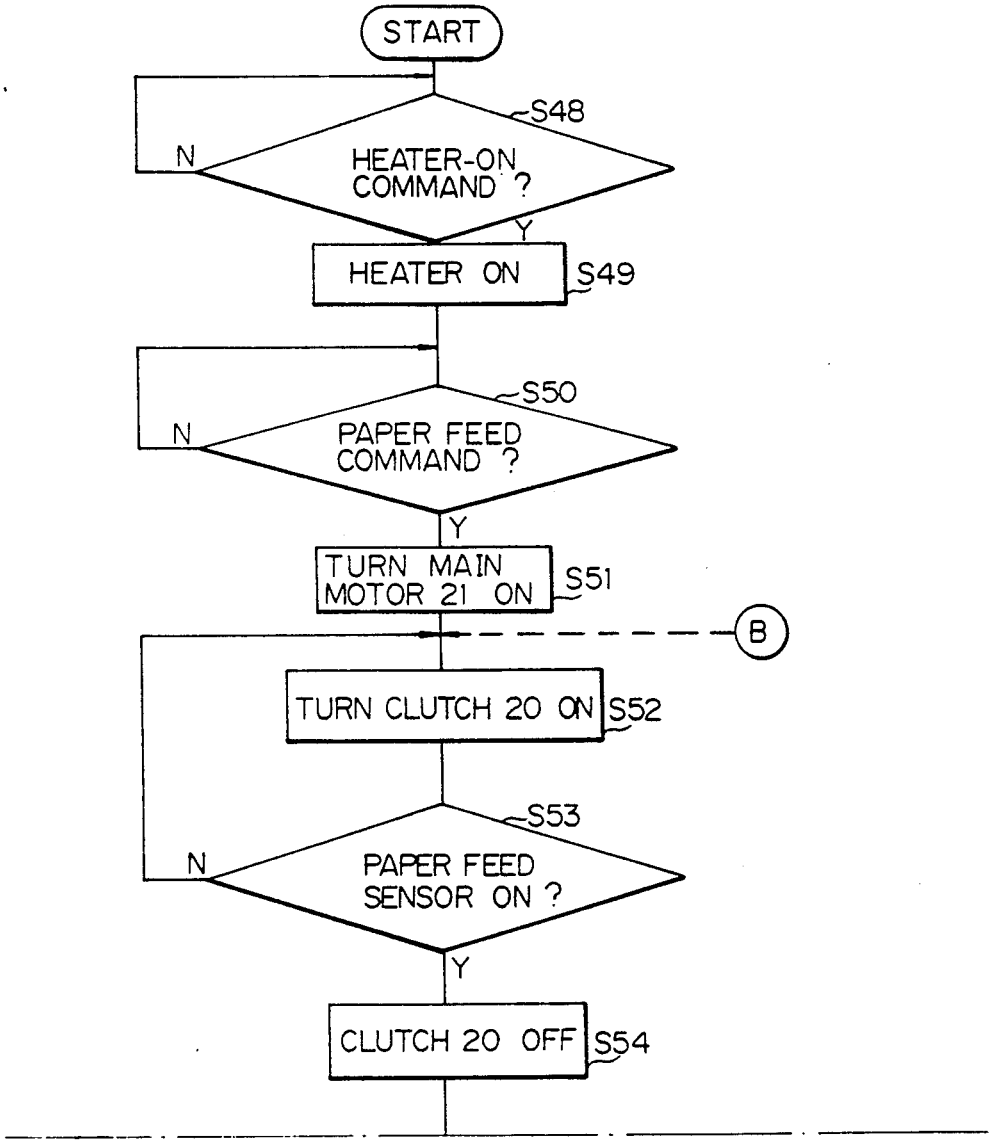
Figures 2, 3A:
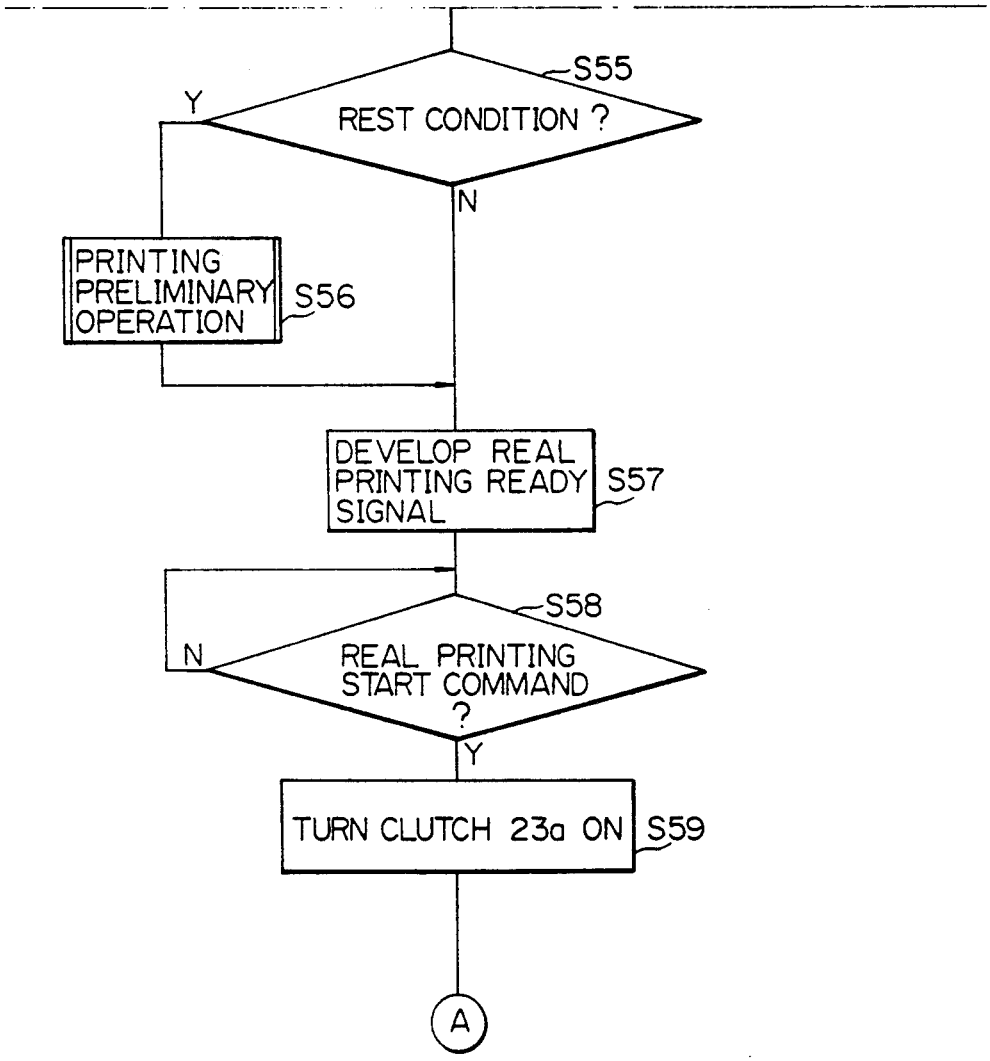
Figure 3B:
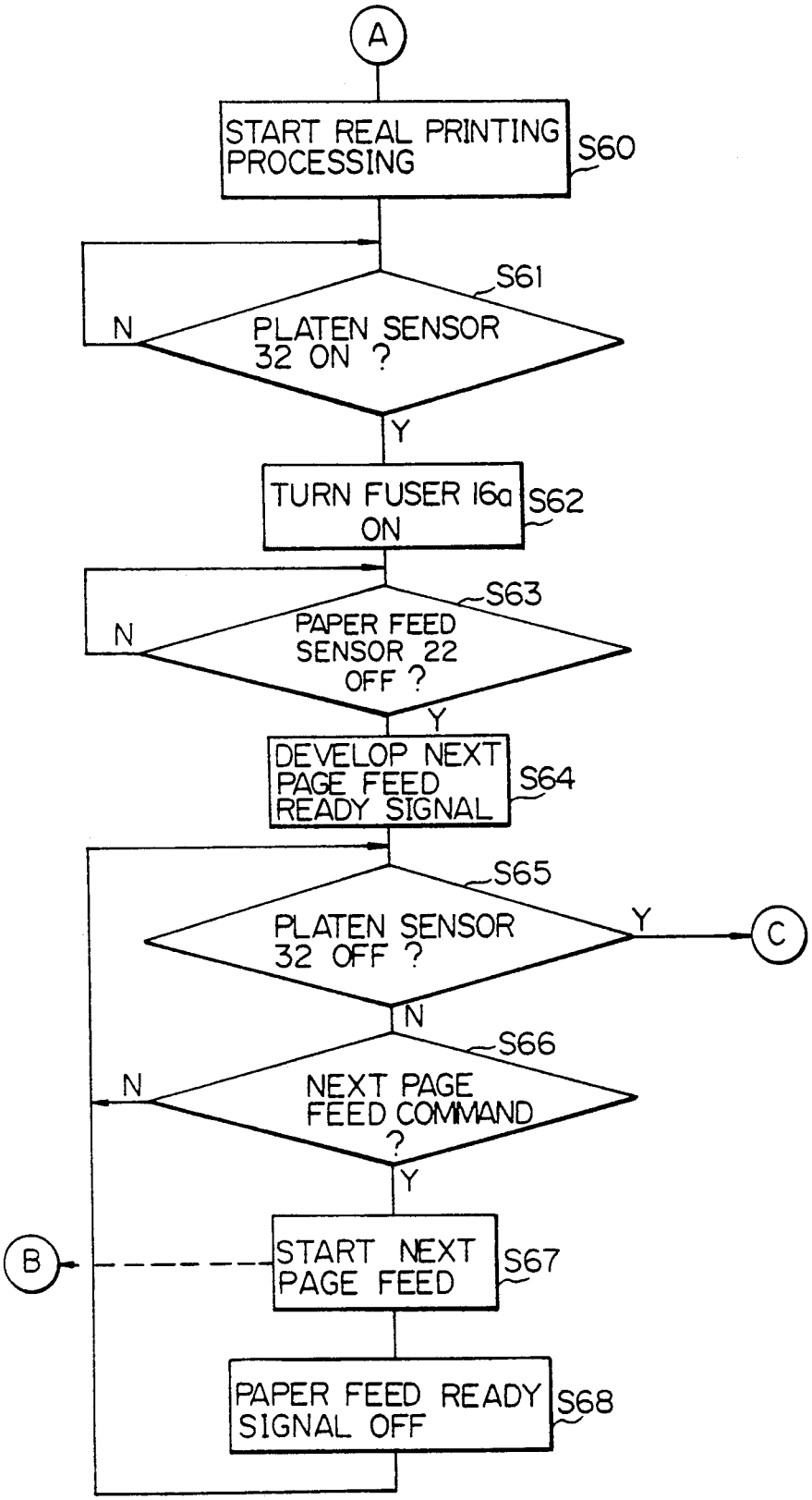
Figures 1, 2, 3C:
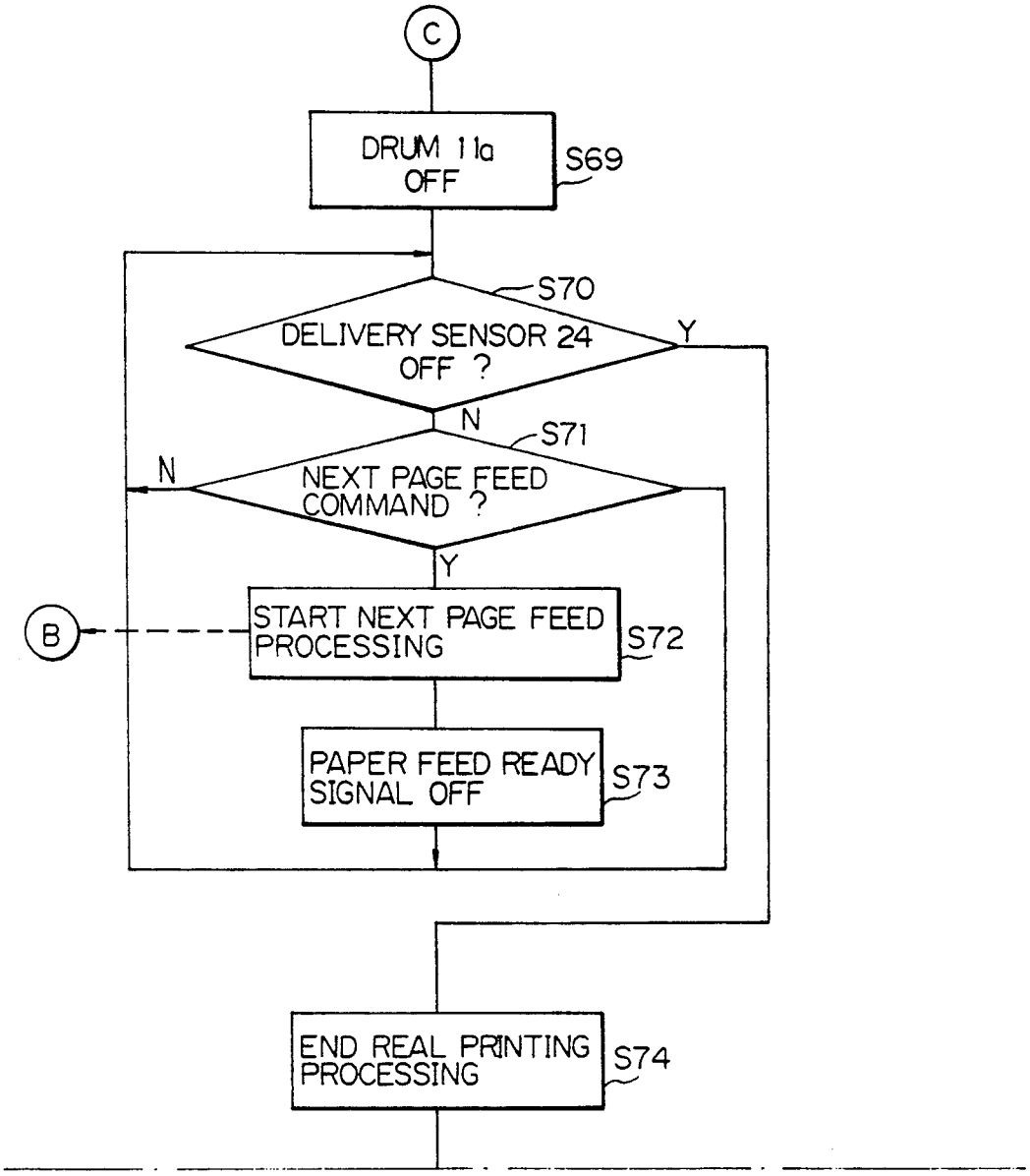
Figures 2, 3C:
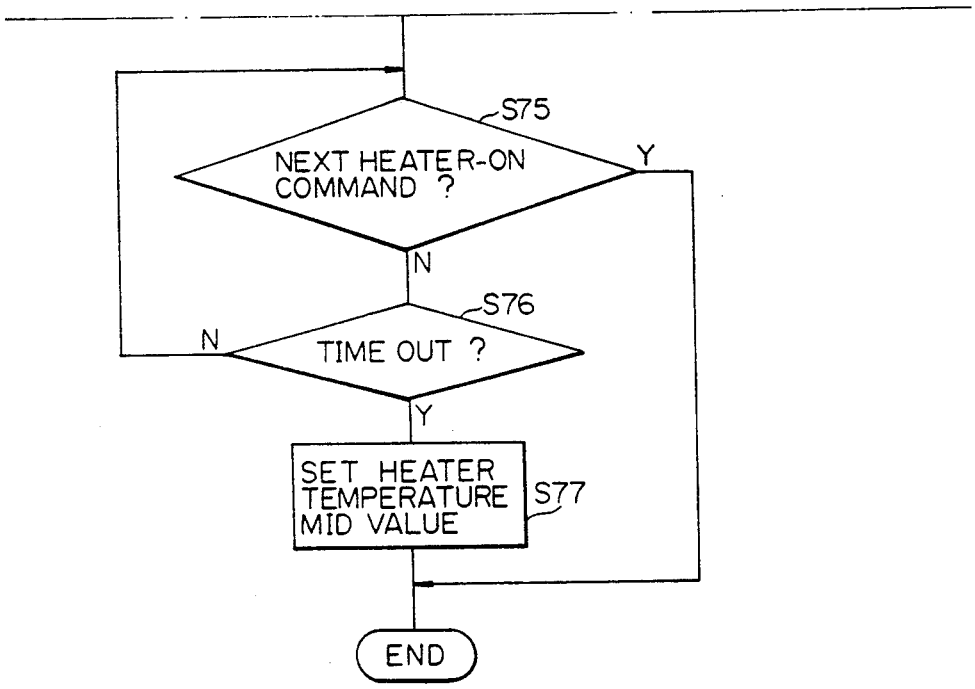
Figure 4:
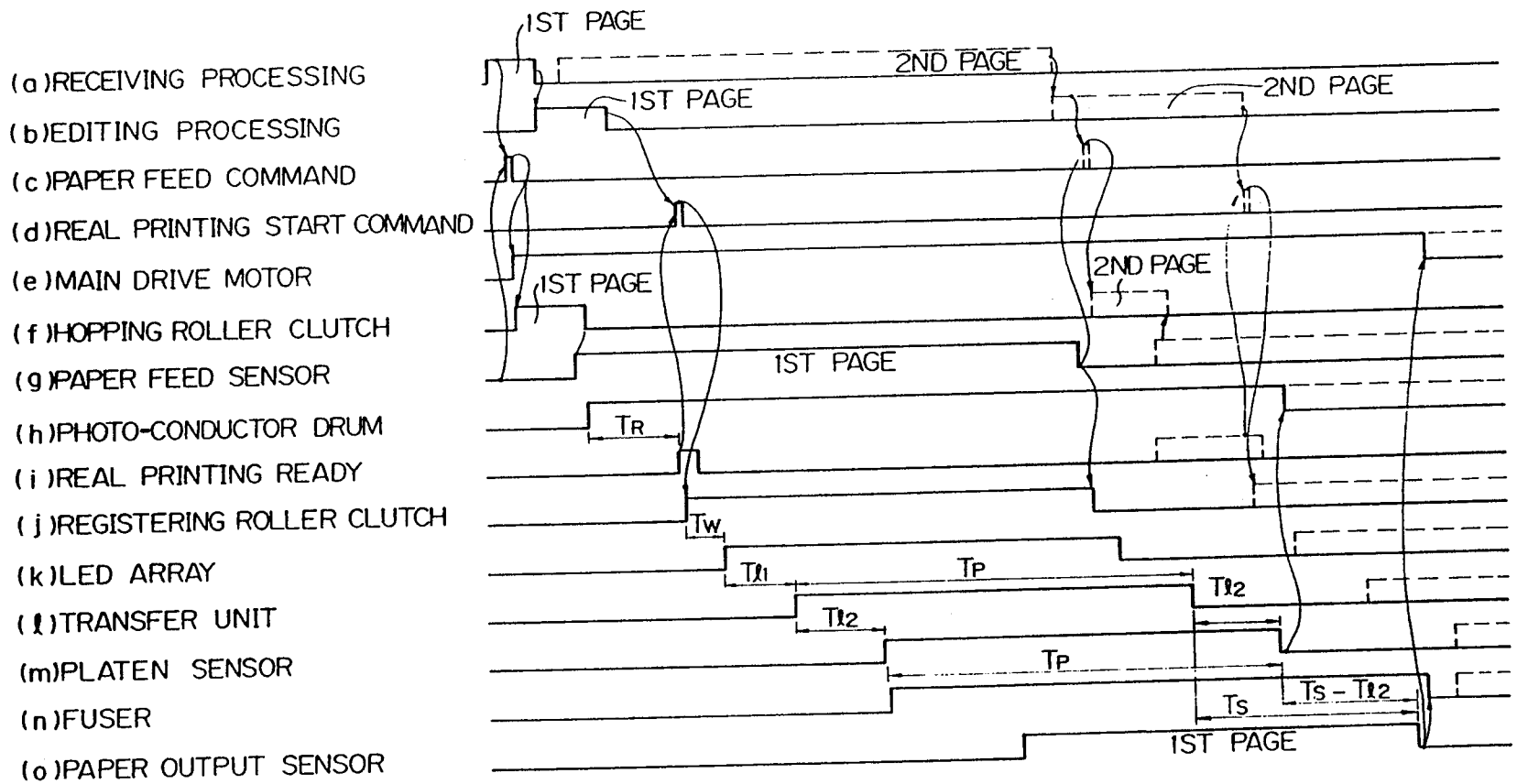
FIG. 4 is a time chart of the image forming apparatus according to the present invention.

Next, the operation of the image forming apparatus according to the present invention will be explained more in detail, referring to FIGS. 2–5, hereinafter. FIG. 2 is an operational flow chart of a control unit of the image forming apparatus according to the present invention. FIGS. 3A, 3B and 3C show an operational flow conducted in a printing unit of the image forming apparatus according to the present invention. FIG. 4 is a time chart of the image forming apparatus according to the present invention, and FIG. 5 is a diagram used for the explanation of the printing unit of the image forming apparatus according to the present invention.

Now referring to FIGS. 2 and 3A-1, 3A-2, 3B, 3C-1 and 3C-2, in steps S30-S32, first, if a first page of printing data is transmitted from the host computer through the terminal unit 9 and the external connection interface unit 3 to a control unit 2*a*, a microprocessor 5*a* determines as to whether the first page of printing data is the printing data at a stage that the first page of printing data is stored in the received buffer 4 of the control unit 2*a*.

In step S33, if the microprocessor 5*a* determines that the transmitted first page of printing data is the printing data, but not font data or the control data, then it transmits a heater turn-on command for a fuser 16*a* of a printer unit 10*a*.

In step S34, the control unit 2*a* determines the absence or presence of a printing paper feed ready signal transmitted from a printing mechanism control unit 26*a* of the printer unit 10*a* through the serial interface 28 (that is, a signal which is generated from printing mechanism control unit 26*a* when the paper feed sensor 22 does not detect the printing paper 31 and thus in condition of the turn. In other words, the control unit 2*a* determines whether the printing unit is ready to feed the printing paper.

In step S35, if the paper feed sensor 22 is in an off condition, and as shown in FIG. 4(*a*), the receiving buffer starts receiving of first page of printing data, the microprocessor 5*a* transmits a printing paper feed command in a timing as shown in FIG. 4(*c*).

In step S36, a receiving processing for the first page of printing data is performed. The processing of the steps S30–S34 are performed until the receiving processing is completed, and in addition, those steps through a "paper fed" (such a condition that the paper feed sensor 22 is turned off and the printing paper feed command has already been transmitted) route 44 to step S36 are repeated.

If the receiving processing for the first page of printing data is completed, an editing processing for the first page of printing data starts (step S37). The microprocessor 5*a* repeats, until the editing processing for the first page of printing data is completed (step S38), the steps from step S38 to step S34, through the "paper fed" route 44 further to steps S36–S38, S34 and S36–S38 in the order named.

In steps S39 and S40, if the editing processing for the first page of printing data is completed, the procedure goes through a "paper fed" route 46 to step S41. If the paper feed sensor 22 is turned off at the point of time when the editing processing for the first page of printing data is completed, then the procedure goes to step S41 to generate the printing paper feed command. The receiving processing (refer to FIG. 4(*a*)) for the printing data by the receiving buffer 4 and the editing processing (refer to FIG. 4(*b*)) for the printing data by the microprocessor 5*a*, which is carried out after the receiving processing, are performed in the same way as the conventional ones.

In step S41, it is determined whether a printer unit 10*a* is available for a real printing. Upon receipt of a real printing ready signal from the printing mechanism control 26*a*, when the editing processing for a first page of printing data has been completed, the microprocessor 5*a* determines that the printer unit 10*a* is in a condition for allowance of a real printing, and transmits a real printing start command (step S42) through the serial interface 28 to the printing mechanism control 26*a* of the printer unit 10*a* to start the real printing processing (step S43) such as dot image data transfer, see FIG. 4(*b*).

Now referring to FIG. 3A-1, in steps S48 and S49, upon receipt of the heater turn-on command in the step S33, the printing mechanism control 26*a* of the printer unit 10*a* turns on a heater of the fuser 16*a*. In steps S50 and S51, upon receipt of the printing paper feed command in step S35, the printing mechanism control 26*a* turns on the main drive motor 21 in a timing as shown in FIG. 4(*e*).

Figure 5A:
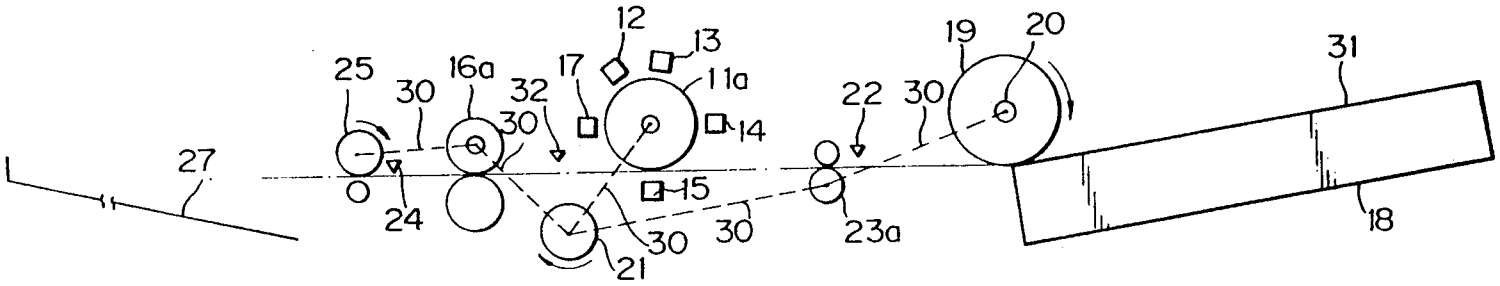
FIGS. 5A, 5B, 5C, 5D, 5E, 5F, 5G, 5H, 5I, 5J, and 5K are diagrams used for the explanation of the printing unit of the image forming apparatus according to the present invention.

In step S52, when the main drive motor 21 reaches a stable rotation condition, the hopping roller clutch 20 is turned on in a timing as shown in FIG. 4(*f*) to start taking out the printing paper 31 from the printing paper feeding unit 18 (refer to FIG. 5A).

In step S53, when the paper feed sensor 22 detects the printing paper 31 taken out from the printing paper feeding unit 18 and thus turns on, it informs the printing mechanism control 26*a* (refer to FIG. 4(*g*)).

Figure 5B:
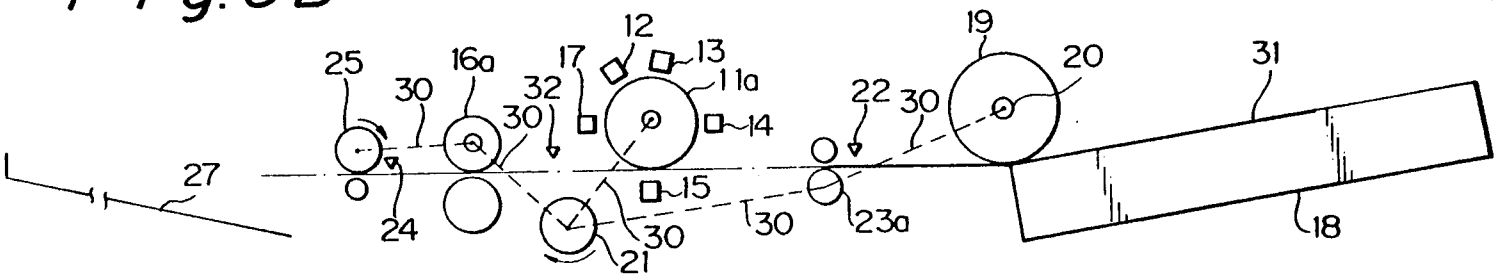
Figure 5C:
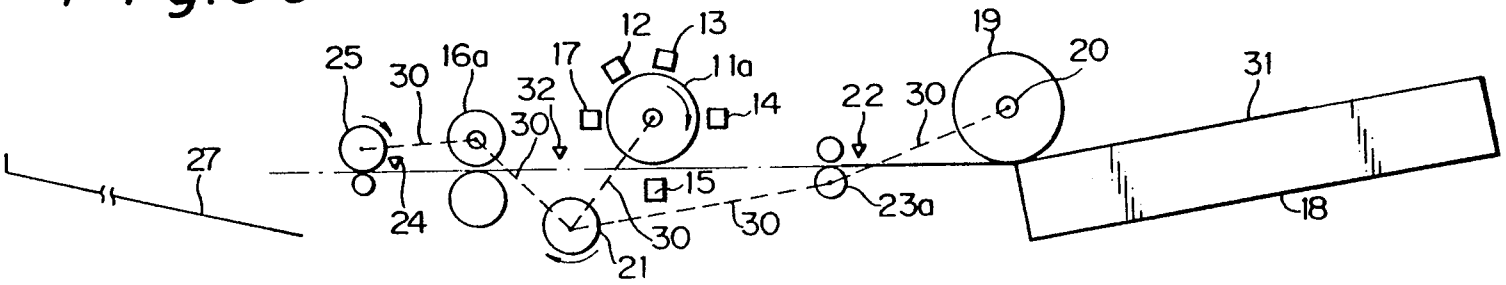

In step S54, when the printing paper 31 arrived at the paper feed sensor 22, the printing mechanism control 26*a* gives an instruction for turn-off to the hopping roller clutch 20 in a timing as shown in FIG. 4(*f*) to stop the operation thereof (refer to FIG. 5B).

In steps S55 and S56, when the printer unit 10*a* is in a rest condition (that is, such a stop condition that the operations of charging on the photoconductor drum 11*a*, exposure, developing and so on are not performed), the printing mechanism control 26*a* turns on a clutch of the photoconductor drum 11*a* to start a printing preliminary operation. In a case where a time required for taking out the printing paper from the printing paper feeding unit 18 is short, it is permitted to simultaneously perform the printing preliminary operation. At that time, the photoconductor drum 11*a* is rotated in a direction of arrow 111 by power through the power transmission means 30, such as a transmission, gear and belt for power transmission so as to uniformly charge the photoconductive surface thereof by the electrostatic charger, and the developing roller, etc. of the developing unit 14 is rotated to charge the toner with the frictional electrostatic charge (refer to FIG. 5C).

In step S57, one or two revolutions of the photoconductor drum 11*a* provides a real printing ready condition, and the printing mechanism control 26*a* transmits, upon receipt of information (a turn-on signal indicating that the paper feed sensor 22 detected the printing paper 31) from the paper feed sensor 22 and in addition information of completion of the preliminary operation for printing, a real printing ready signal through the serial interface 28 to the microprocessor 5*a* of the control unit 2*a*. In a case where the printer unit 10*a* has received the previous page of printing data and is in a real printing processing condition in step S55, the procedure goes to the step S57, without starting the preliminary operation for printing, and the printing mechanism control 26*a* immediately transmits the real printing ready signal to the control unit 2*a*.

In steps S58 and S59, upon receipt of the real printing start command, the printing mechanism control 26*a* turns on a registering roller clutch 23*a* as shown in FIG. 4(*j*) to resume a transfer of the printing paper.

In step S60, the printing mechanism control 26*a* starts the real printing processing to form an electrostatic latent image on the surface of the photoconductor drum 11*a* by the light emitting diode 13, when a predetermined time TW elapsed after resumption of a transfer of the printing paper. At that time, there is provided such a relation that a distance $l_1$ from the light emitting diode 13 on the photoconductor drum 11*a* to the transfer unit 15 equals to a remaining carrying distance 11 for the printing paper until it reaches the transfer unit 15. In order to perform writing onto the photoconductor drum 11*a*, the printing mechanism control 26*a* requests the control unit 2*a* through the serial interface 28 to send a first page of printing data (refer to FIG. 5D). At the same time, the printing mechanism control 26*a* turns on the clutch of the photoconductor drum 11*a* to start the rotation thereof in a direction of arrow 111, so that the surface of the photoconductor drum 11*a* is charged with the negative electricity (−). When the dot image data are transmitted from the microprocessor 5*a* of the control unit 2*a* through the video interface 29 to the light emitting diode 13, the writing onto the photoconductor drum 11*a* is performed. The dot image data are sequentially written onto the photoconductor drum 11*a* in synchronism with the transfer of the printing paper. When the photoconductor drum 11*a* is rotated, the developing unit 14 develops the latent images in the order of writing, and the thus developed toner images are transferred to printing paper 31 by the transfer unit 15 (refer to FIG. 5E).

In step S61, when the photoconductor drum 11*a* is rotated, after the transfer operation, by distance 12 to arrive at the position of the cleaner 17 for removing the residual toner and electrostatic charge, the printing paper 31 is transferred to the platen sensor 32, so that the platen sensor 32 is turned on.

Figures 5D, 5E, 5F:
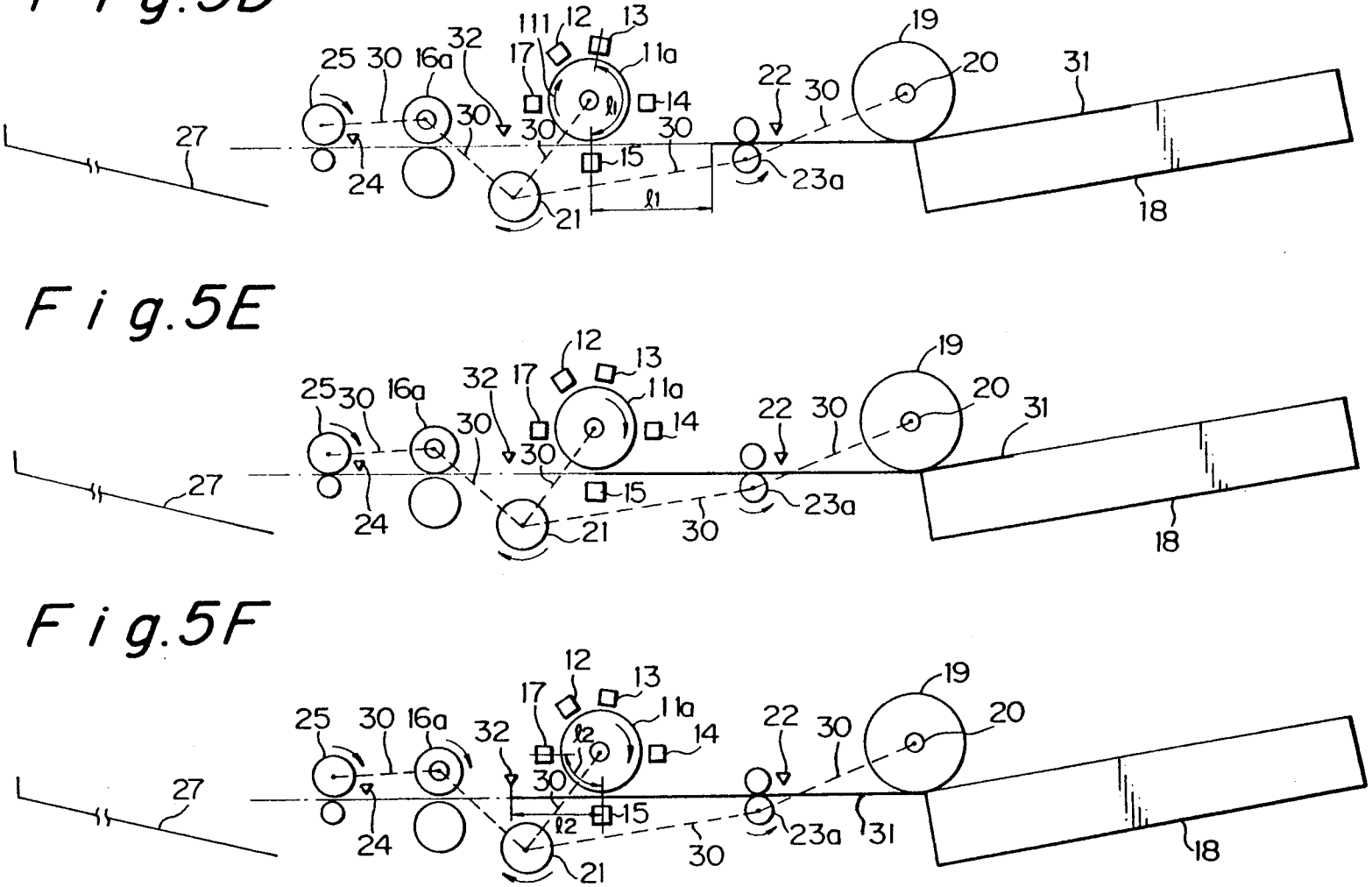
Figure 5G:
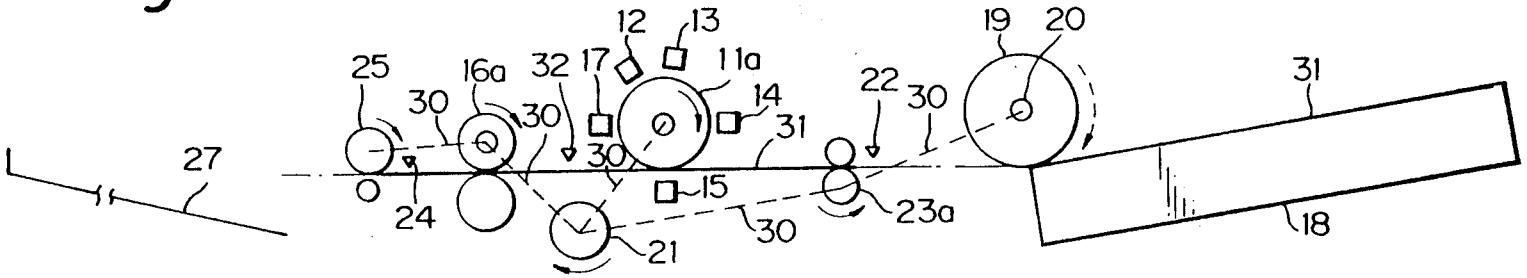

In step S62, in response to a turn-on signal of the platen sensor 32, the printing mechanism control 26*a* turns on the clutch of the fuser 16*a* to start a fixing operation (refer to FIG. 5F). When the clutch of the fuser 16*a* is turned on, a roller self containing a heater subjected to a Teflon coating process and a pressure roller consisting of a silicone rubber are rotated in such a relation that they are in contact with each other, so that a uniform fusing temperature can be obtained. Therefore, it is necessary for the fuser 16*a* to rotate several turns until the printing paper 31 arrives thereat. Taking this into account, a distance between the fuser 16*a* and the platen sensor 32 is determined. If no adequate distance is provided, there is a case that the clutch of the fuser 16*a* is turned on in response to detection of turn-on of the paper feed sensor 22. The fusing is performed under high temperature 150° C.–190° C. and thus raising of the temperature takes time. Accordingly, the heater of the fuser 16*a* is turned on, as mentioned above, when the microprocessor 5a recognizes that the printing data from the host computer is received, and informed of it the printing mechanism control 26a through the serial interface 28 (steps S33, S48 and S49 in FIG. 3), or when the printing paper 31 is taken out from the printing paper feeding unit 18 (step S52 in FIG. 3).

In step S63, the real printing operation is sequentially performed and the printing paper 31 is transferred in synchronism with the real printing operation. When the trailing edge of the printing paper 31 is passed through the paper feed sensor 22 (refer to FIG. 5G), the paper feed sensor turn-off signal is notified to the printing mechanism control 26a.

In step S64, upon detection of the paper feed sensor turn-off signal, the printing mechanism control 26a transmits to the control unit 2a a signal indicating that the next page (for example, second page) of printing paper is ready to be fed.

Next, the receiving processing and the editing processing for the second page of printing paper will be explained referring to the flow chart of FIG. 2.

First, regarding the receiving processing, as shown in FIG. 4(*g*), the microprocessor 5a repeats, until the paper feed sensor 22 is turned on, the steps S30 to S34, through the "paper fed" route 44 further to steps S36, S30, and S31 in the order named. When the paper feed sensor 22 is turned on, the route is switched from the "paper fed" route 44 to route 45 in step S34, and other steps are repeated on the same basis.

If the receiving processing for the second page of printing data is completed, the procedure goes from step S31 to step S37 and an editing processing for the second page of printing data starts. In the editing processing, as shown in FIG. 4(*g*), the microprocessor 5a repeats, until the paper feed sensor 22 is turned off, the steps from step S36, step S38 to step S34, through the right side route 45 (in such a condition that the paper feed sensor is turned off) further to steps S36–S38 in the order named. When the paper feed sensor 22 is turned off, as shown in FIG. 4(*g*), the microprocessor 5a receives the printing paper feed ready signal from the printing mechanism control 26a. Thus, the procedure advances from step S34 to step S36, as shown in FIG. 4(*c*), to transmit the printing paper feed command to the printing mechanism control 26a. If the printing mechanism control 26a receives the printing paper feed command, the printer unit 10a performs the same operation as in the case of the printing processing for the first page of printing data. After the printing paper feed command is transmitted in step S35, the microprocessor 5a repeats the steps from steps S36–S38 to step S34, through the route 44 further to steps S36–S38 in the order named. If the editing processing for the second page of printing data is completed, the procedure goes from step S38 through S39 and the route 46 to step S41. The procedure after the step 41 is performed on the same basis as in case of the first page of printing data.

Next, there will be explained receipt of a printing paper feed command for the next page (second page) in the printer unit 10a and the operational flow in connection therewith.

In step S65, there is a waiting time for a printing paper feed command for the next page during a period of time until the printing paper 31 passes through the platen sensor 32 after passing through the paper feed sensor 22.

In steps S66–S67, if the printing paper feed command for the next page is received, the procedure advances to step S67, so that the printing mechanism control 26a performs a feeding operation for the printing paper or sheet in a timing as shown in FIG. 4(*f*), on the same basis as in the first page.

In step S68, the printing paper feed ready signal is turned off to wait for a time when the trailing edge of the previous page (the first page) of the printing paper 31 passes through the platen sensor 32.

In step 69, when the platen sensor 32 detects the passage of the printing paper, the photoconductor drum 11a is turned off. Also when the trailing edge of the printing paper 31 has passed through the platen sensor 32 before the printing paper feed command for the next page is transmitted from the control unit 2a, the photoconductor drum 11a is turned off, that is, the procedure advances from step S65 to step S69.

Figure 5H:
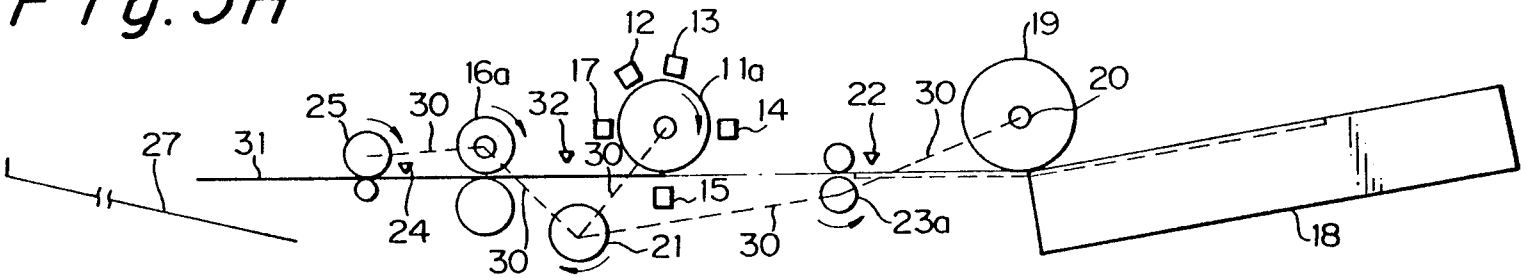
Figure 5I:
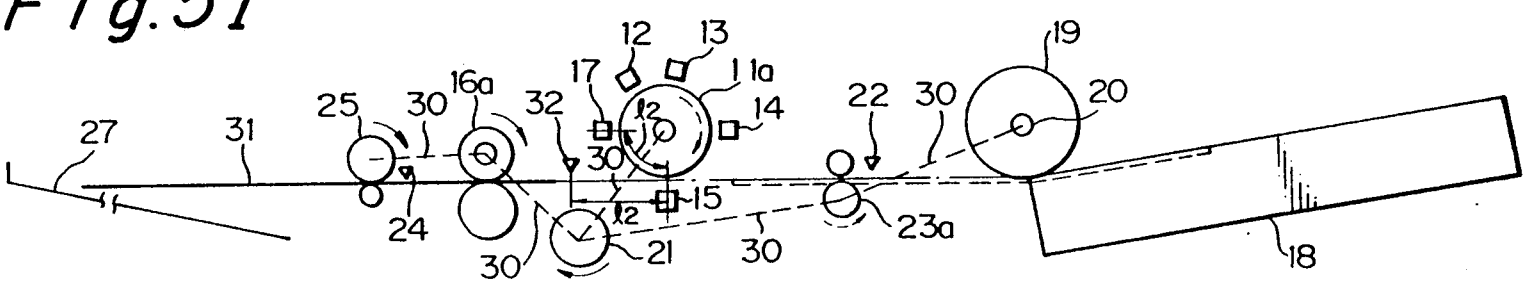
Figure 5J:
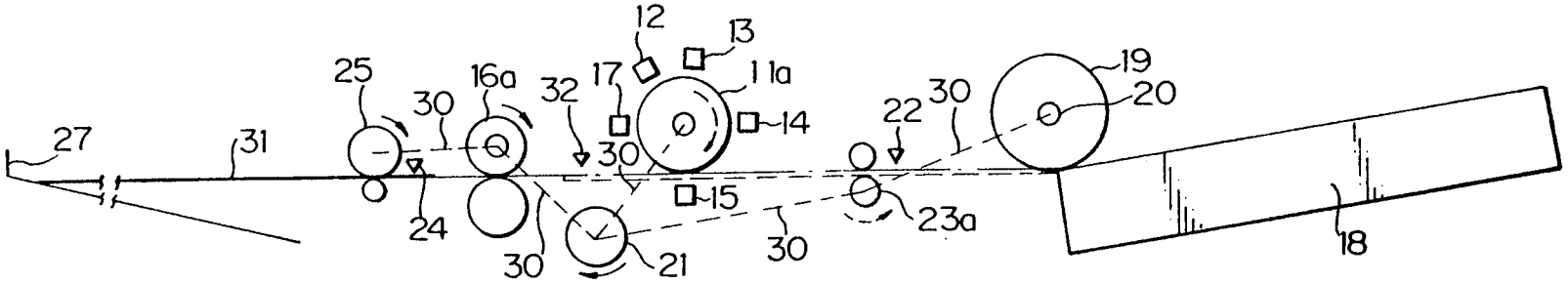
Figure 5K:
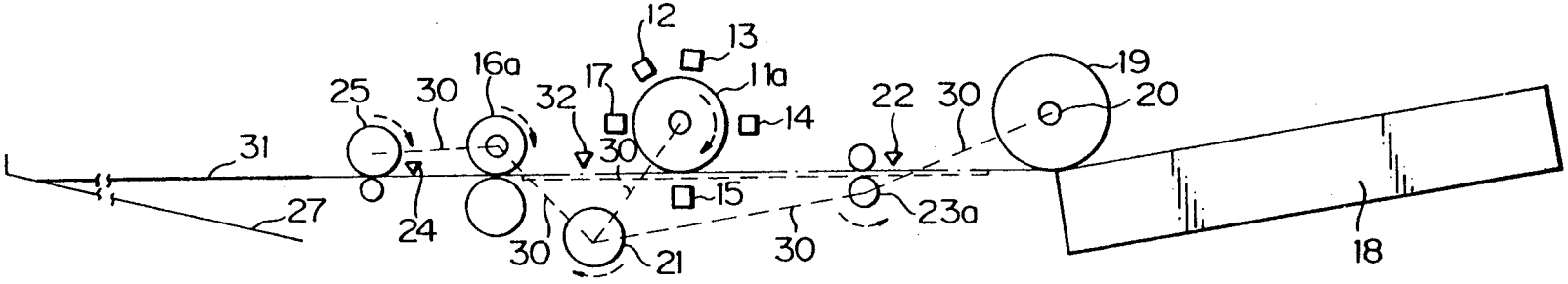

FIG. 5H shows a condition of completion of a transfer operation for a page of printing data, and FIG. 51 shows such a condition that the trailing edge of the printing paper 31 has passed through the platen sensor 32, as mentioned above. At that time, if the residual toner and electric charge on the photoconductive surface of the photoconductor drum 11a have already been removed by the cleaning brush or the cleaning blade, and further no next page (second page) of printing data is transmitted to the printing mechanism control 26a, the clutch of the photoconductor drum 11a is turned off in a timing shown in FIG. 4(*h*), and at the same time the toner replenishment roller and the developing roller of the developing unit 14 are stopped to stop the toner replenishment. Thereafter, it is waited that the fixing operation for the toner image transferred to the printing paper 31 is carried out and the printing paper 31 passes through the paper output sensor 24 (step S70). In a case where the printing paper feed command for the next page has not yet been received during such a waiting time, the printing paper feed command is waited (step S71).

In steps S72–S73, if the printing paper feed command for the next page is received, the same processing as in the steps S67–S68 is performed.

In steps S75–S77, if the fixing operation is completed (refer to FIG. 5J) and the trailing edge of the printing paper 31 passes through the paper output sensor 24 (refer to FIG. 5J), the printing mechanism control 26a detects turn off of the paper output sensor 24 and stops the clutch of the fuser 16a and rotation of the main drive motor 21.

The heater of the fuser is set in temperature, after a predetermined time, to a mid temperature lower than the fixing temperature so that the span of life of the parts, which parts are provided for quick start-up for the successive printing, is prevented from being shortened. However, in a case where the printing paper feed command and the printing data for the next page have already been received, the rotation of the main drive motor is continued, and the clutch of the fuser 16a is turned on again in the timing as stated above, that is, when the platen sensor 32 is turned on.

Figure 13:
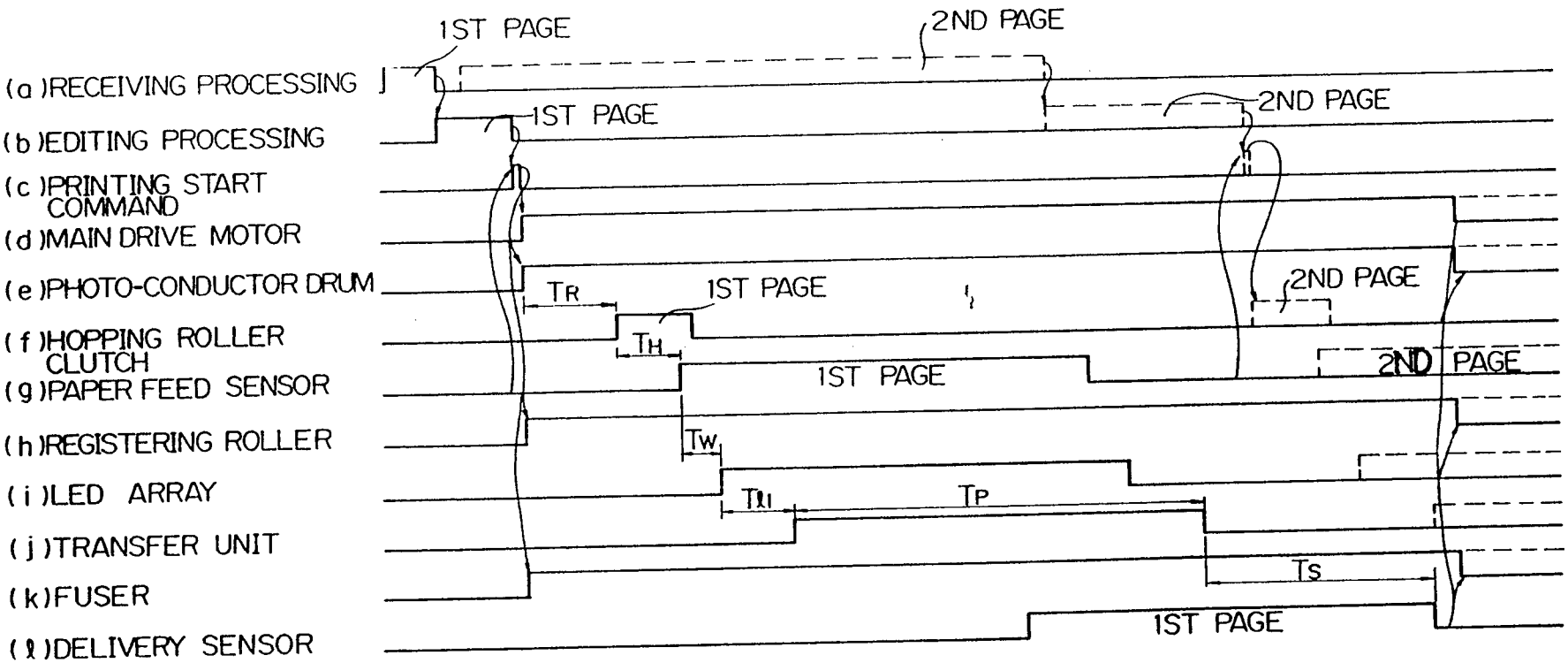
Fig. 13 PRIOR ART
FIG. 13 is a time chart of the conventional image forming apparatus.
Figure 14A:
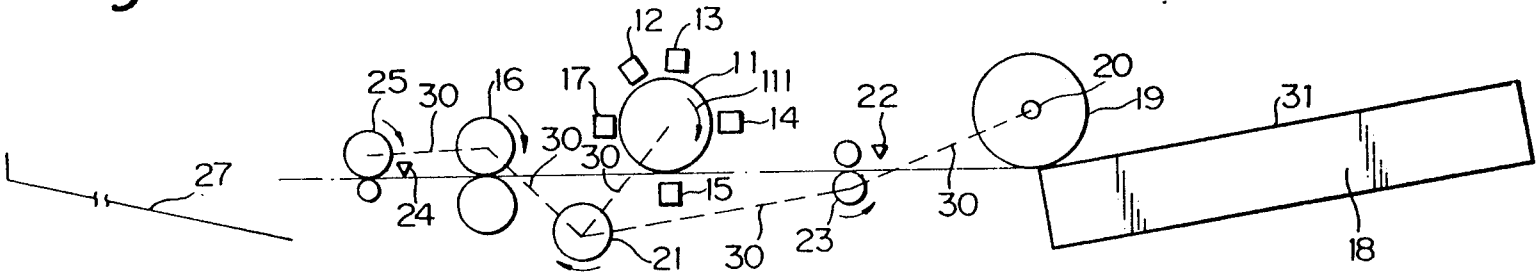
FIGS. 14A, 14B, 14C, 14D, 14E, 14F, 14G, 14H, 14I, and 14J are the diagrams used for the explanation of the printing unit of the conventional image forming apparatus.
Figure 14B:
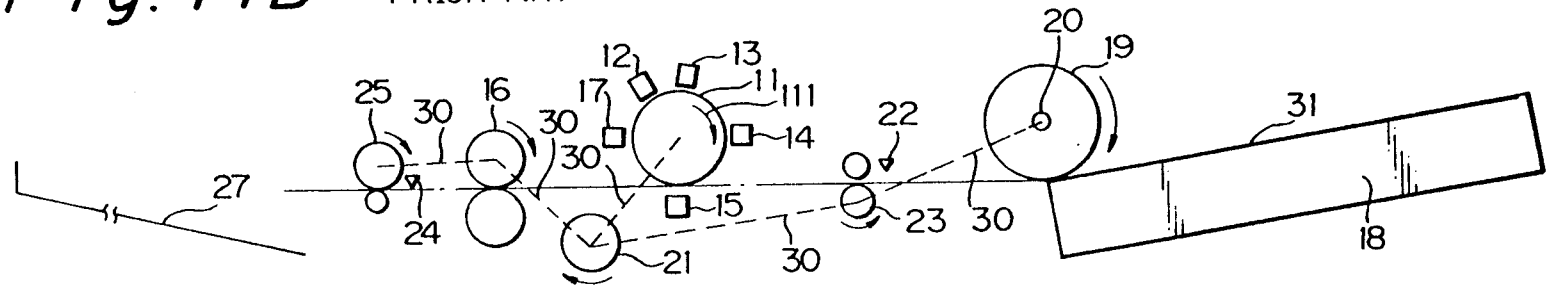
Figure 14C:
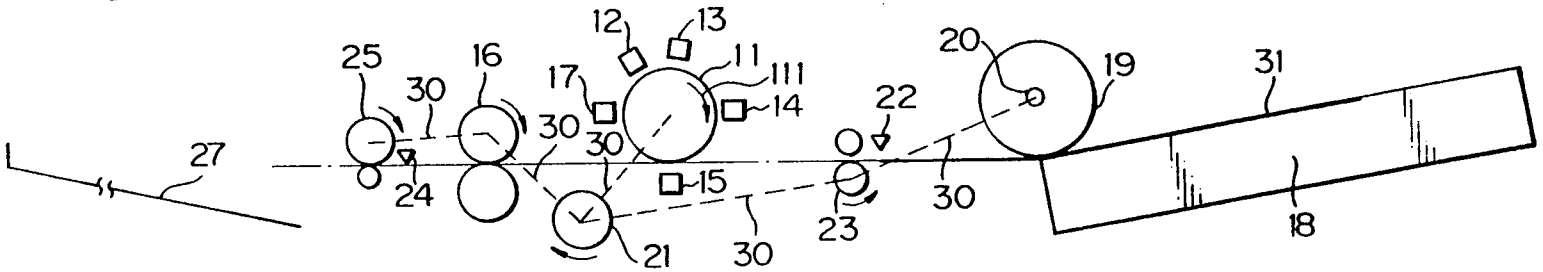
Figure 14D:
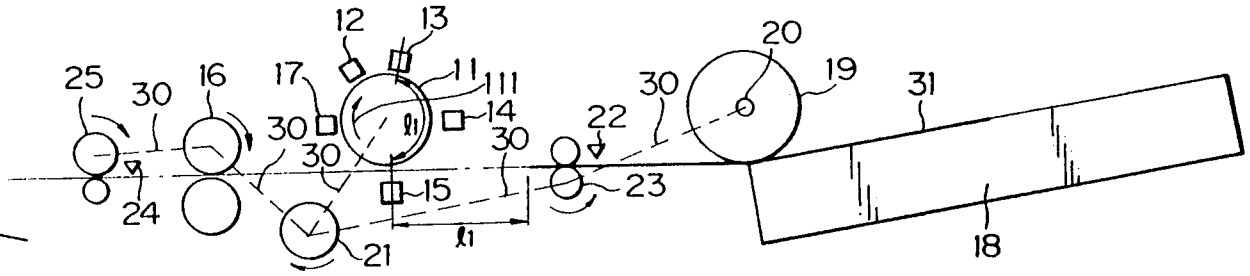
Fig. 14D PRIOR ART
Figure 14E:
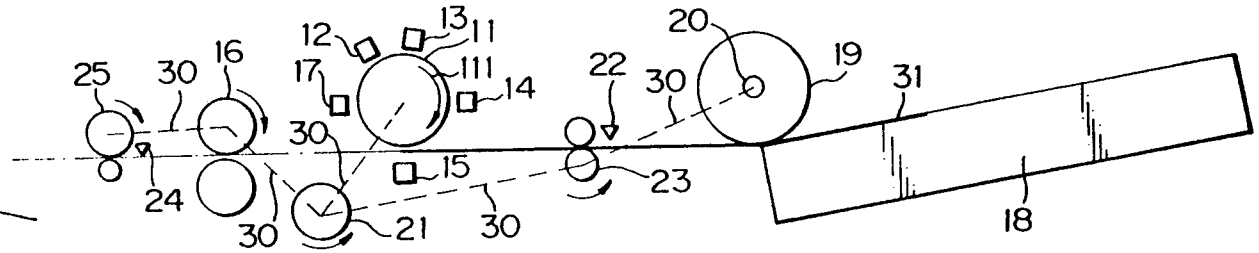
Fig. 14E PRIOR ART
Figure 14F:
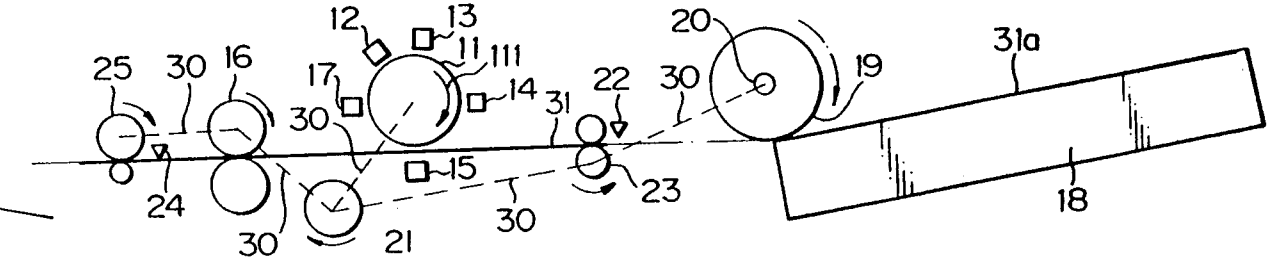
Fig. 14F PRIOR ART
Figure 14G:
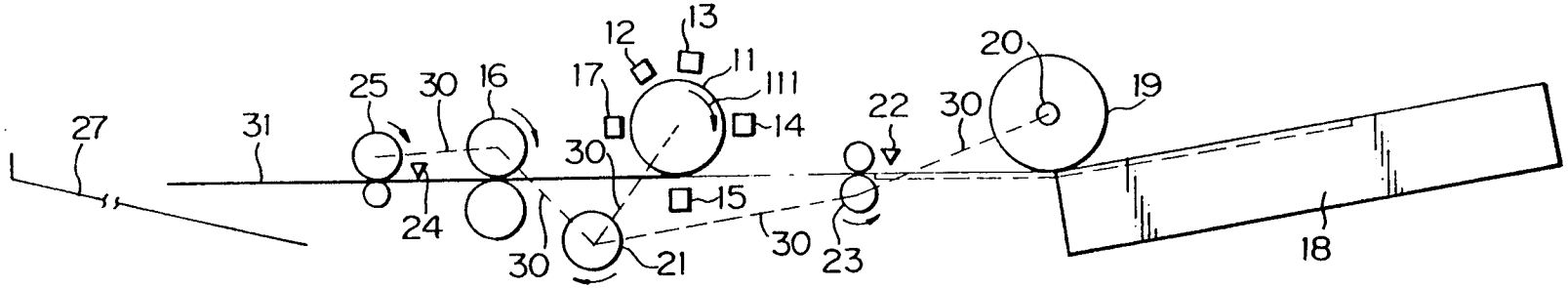
Fig. 14G PRIOR ART
Figure 14H:
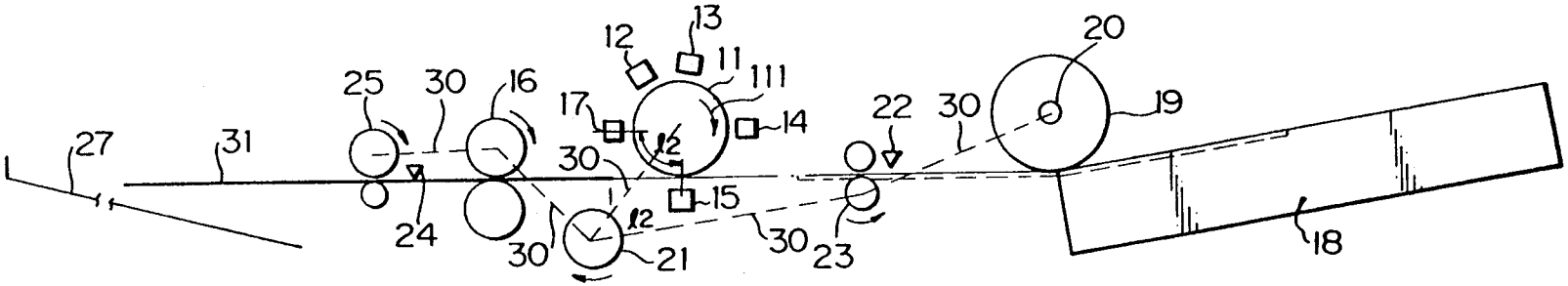
Fig. 14H PRIOR ART
Figure 14I:
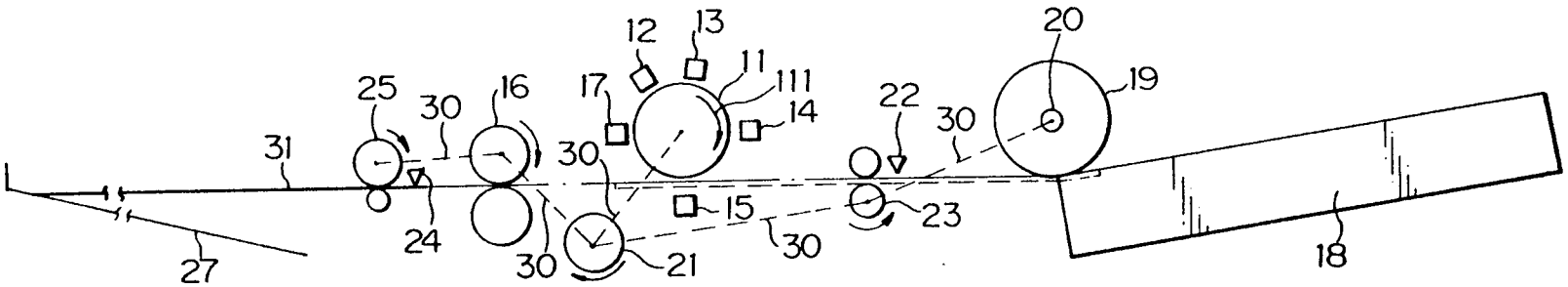
Fig. 14I PRIOR ART
Figure 14J:
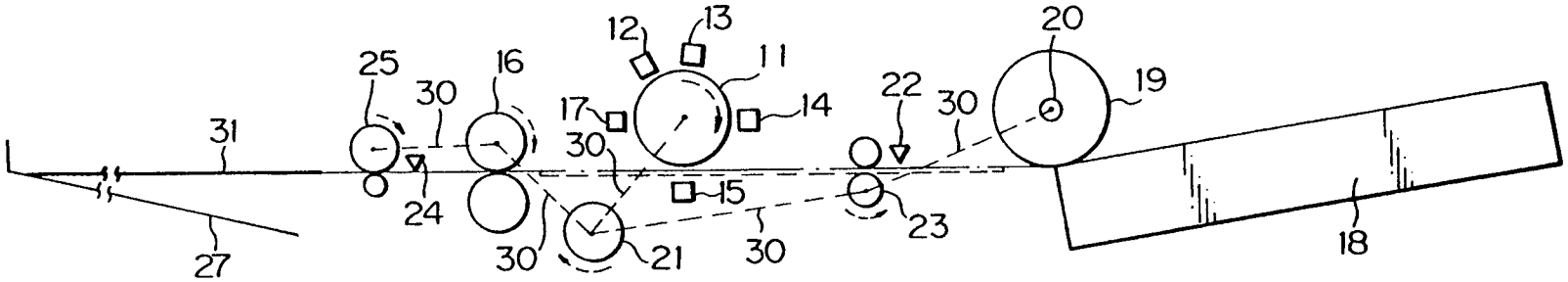
Fig. 14J PRIOR ART

As stated above, the operation times of photoconductor drum 11a, the developing unit 14 and the fuser 16a are dramatically reduced in comparison with that of the convectional image forming apparatus. For example, the operation time of the fuser 16, according to the conventional image forming apparatus, is given by a total time (TR+TH+TW+Tl1+TP+TS), where TR is a preliminary operation time. TH is a printing paper feeding time, TW is a printing paper transfer time until start of print data writing in a real printing ready condition. Tl1 is a printing paper transfer time from a point of time of writing of the printing data until the transfer. TP is a printing paper passage time, and TS is a printing paper transfer time required for transfer of the printing paper from the transfer unit to the paper output sensor (refer to FIG. 13).

Regarding the operation times of photoconductor drum 11 and the developing unit 14, they are given also by a total time (TR+TH+TW+Tl1+TP+TS).

In case of the image forming apparatus according to the present invention, the operation time of the fuser 16a is given by a total time TP+(TS−Tl2), where TP is a printing paper passage time, TS is a printing paper transfer time required for transfer of the printing paper from the transfer unit to the paper output sensor, and Tl2 is a printing paper transfer time required for transfer of the printing paper from the transfer unit to the platen sensor. Regarding the operation times of photoconductor drum 11a and the developing unit 14 they are also given by a total time (TR+TW+Tl1+TP+Tl2).

Thus, according to the present invention, the operation time of the fuser 16a is reduced by a time (TR+TH+TW+Tl1+Tl2), and the operation times of photoconductor drum 11a and the developing unit 14 are reduced by a time (TH+TS−Tl2).

Figure 6:
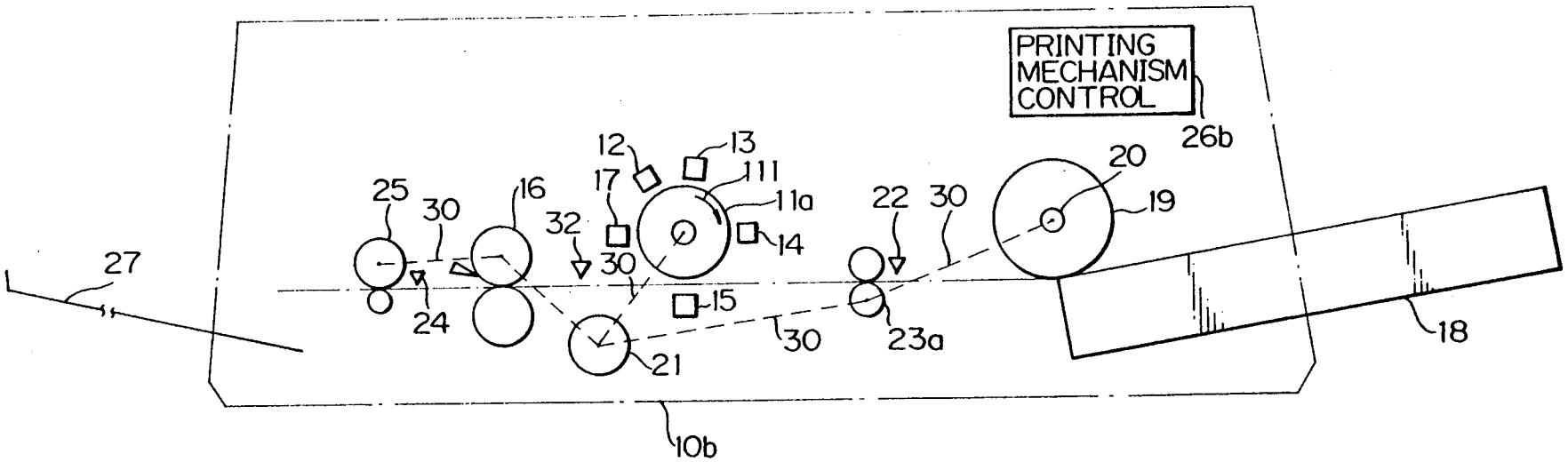
FIG. 6 shows a schematic representation of an image forming apparatus according to a second embodiment of the present invention.

FIG. 6 shows a schematic representation of an image forming apparatus according to a second embodiment of the present invention. In this embodiment, the fuser 16 is coupled directly with the main drive motor 21 through the power transmission means 30 such as the transmission gear and the belt for power transmission, and the turn-on and off of the fuser 16 is controlled in synchronism with the turn-on and off of the main drive motor 21. Further, according to the second embodiment, there is employed a printing mechanism control unit 26b which is different from the printing mechanism control unit 26a of the first embodiment in the program processing and control, so that the photoconductor drum 11a, the developing unit 14, the registering roller clutch 23a and the hopping roller 19 are independently operated. The operation of the second embodiment is the same as that of the first embodiment but for operation timing of the fuser 16, and so on.

Figure 7:
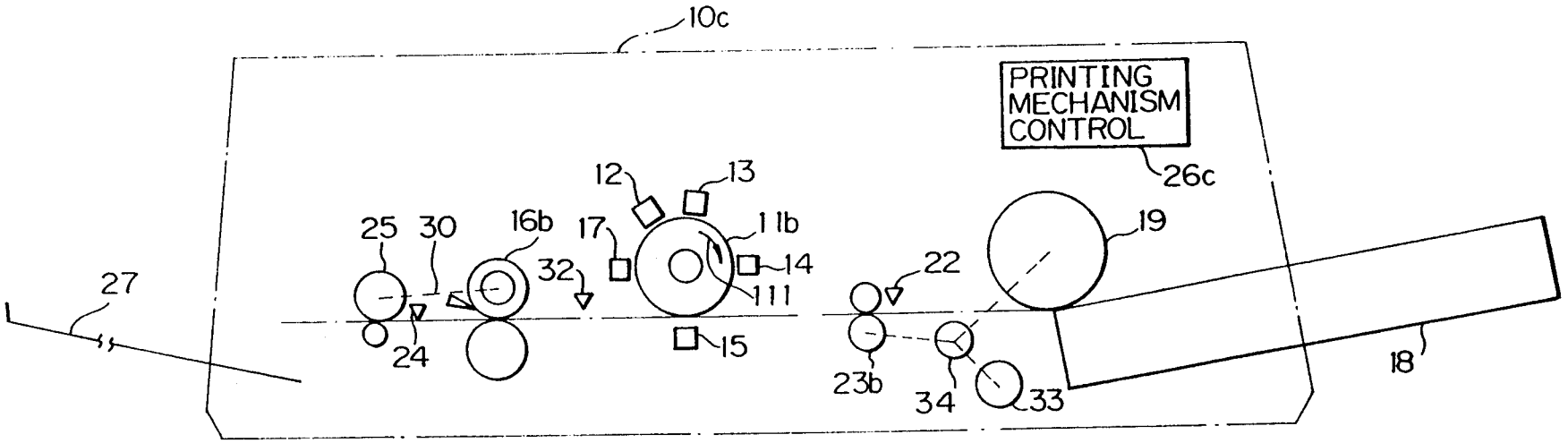
FIG. 7 shows a schematic representation of an image forming apparatus according to a third embodiment of the present invention.

FIG. 7 shows a schematic representation of an image forming apparatus according to a third embodiment of the present invention. In this embodiment, the hopping roller 19, the photoconductor drum 11b and the fuser 16b are independently provided with the power sources such as stepping motors, respectively. According to the third embodiment, the image forming apparatus is provided with a hardware to provide a synchronization of the operations of the hopping roller 19, the photoconductor drum 11b and the fuser 16b with the printing paper transfer, or a software timer by means of program processing for the same object. Further, according to the third embodiment, there is employed a printing mechanism control unit 26c which is different from the printing mechanism control unit 26a of the second embodiment in the program processing and control, so that the photoconductor drum 11b, the developing unit 14, the fuser 16b, the registering roller clutch 23b and the hopping roller 19 are independently operated on a suspension basis.

Figure 8:
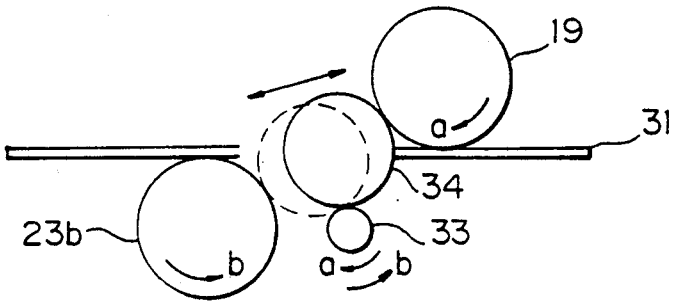
FIG. 8 is a view used for the detailed explanation of the mechanism of the printing paper feed and transfer in the third embodiment of the present invention.
Figure 9:
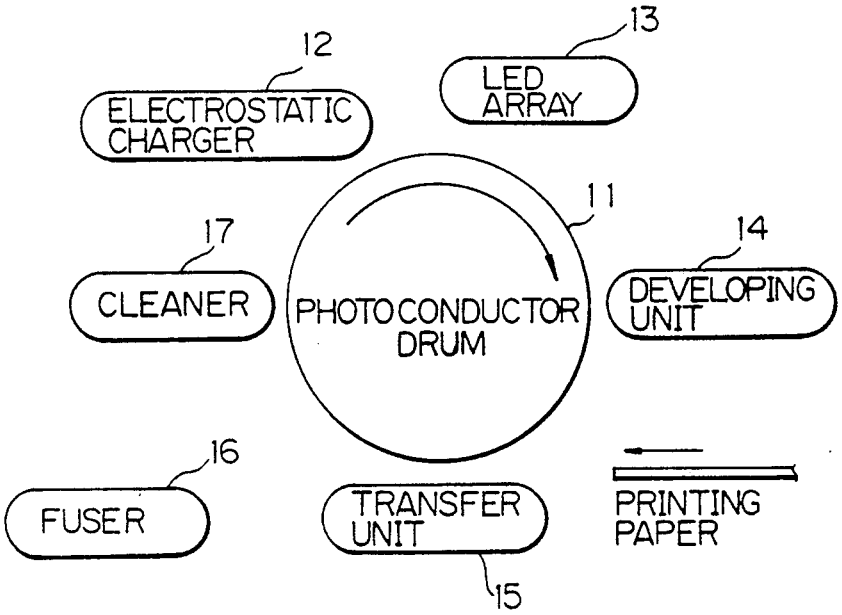
FIG. 9 is a conceptual view for explanation of an electrophotographic process in the image forming apparatus.
Figure 10:
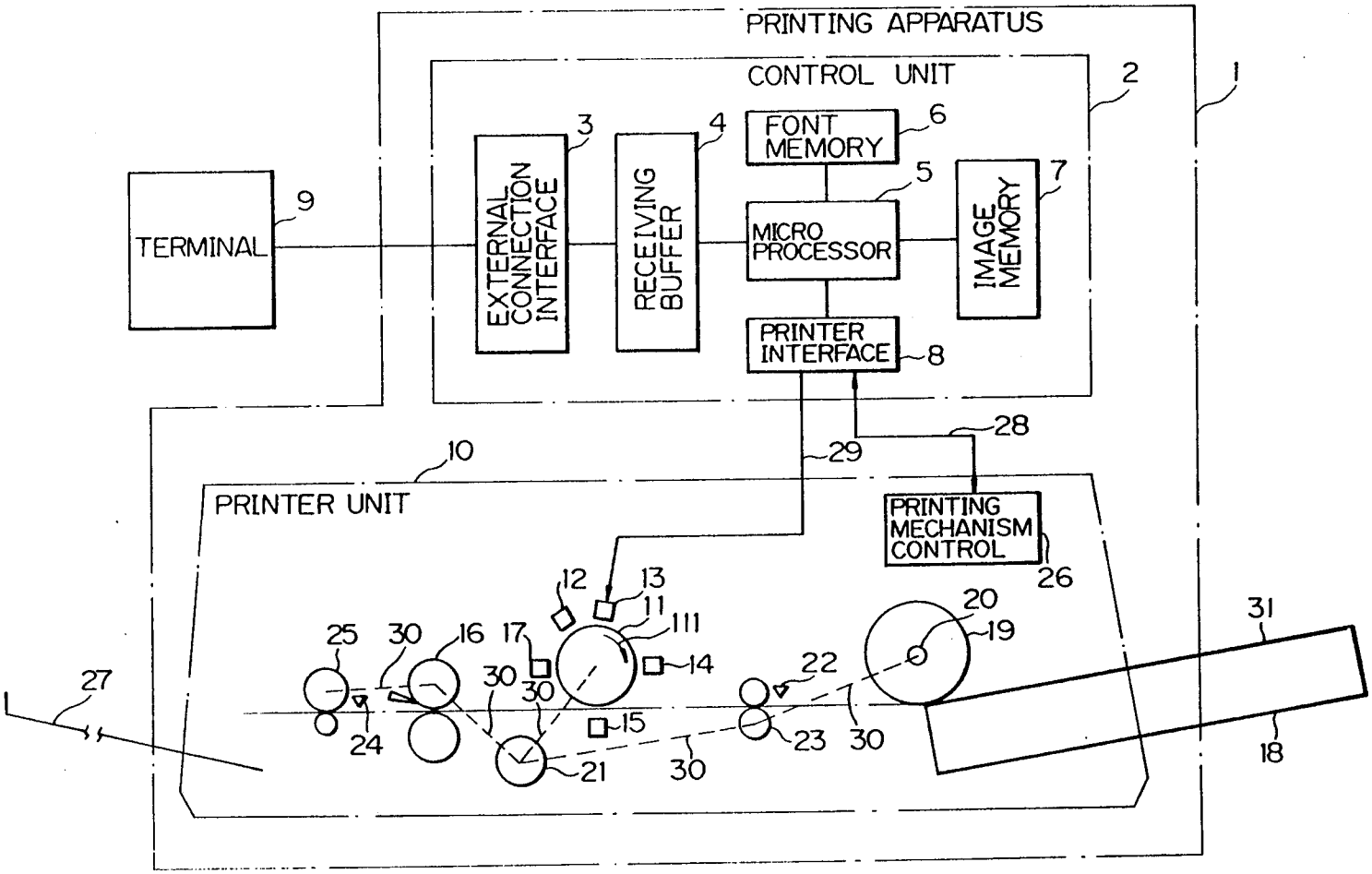
Fig. 10 PRIOR ART
FIG. 10 is a schematic representation of the conventional image forming apparatus.
Figure 11:
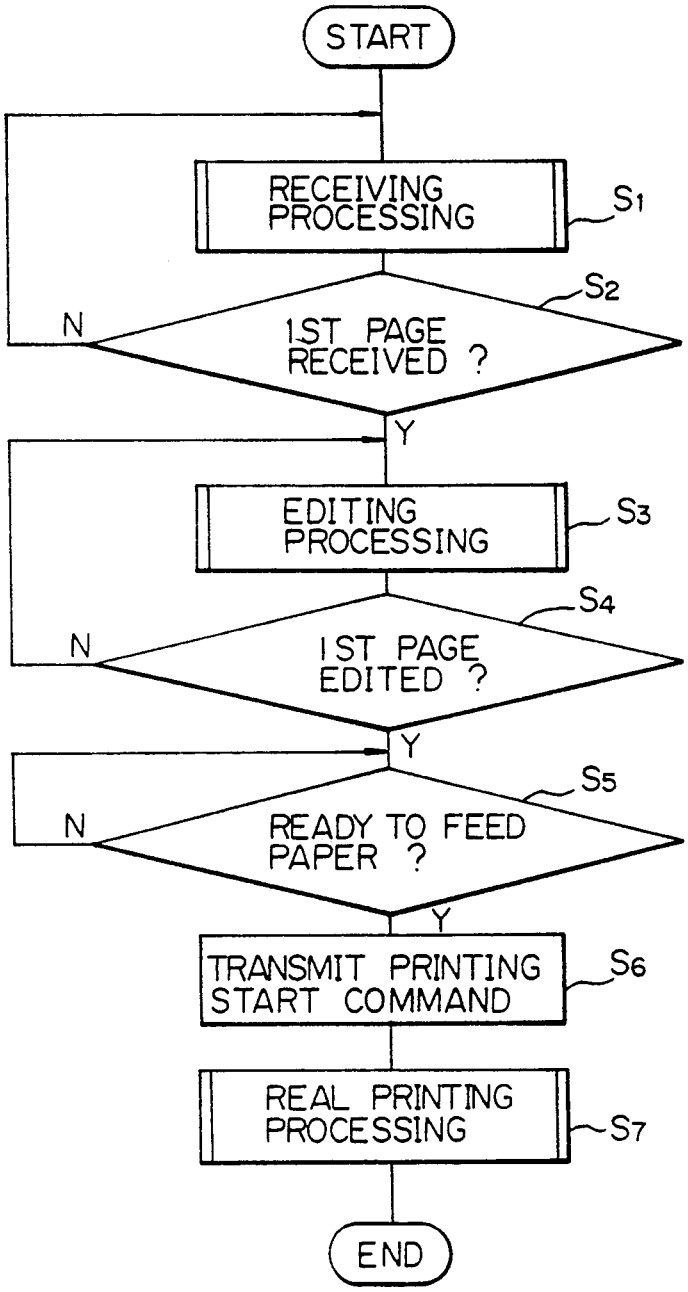
Fig. 11 PRIOR ART
FIG. 11 shows an operational flow of a control unit of the conventional image forming apparatus.
Figure 12A:
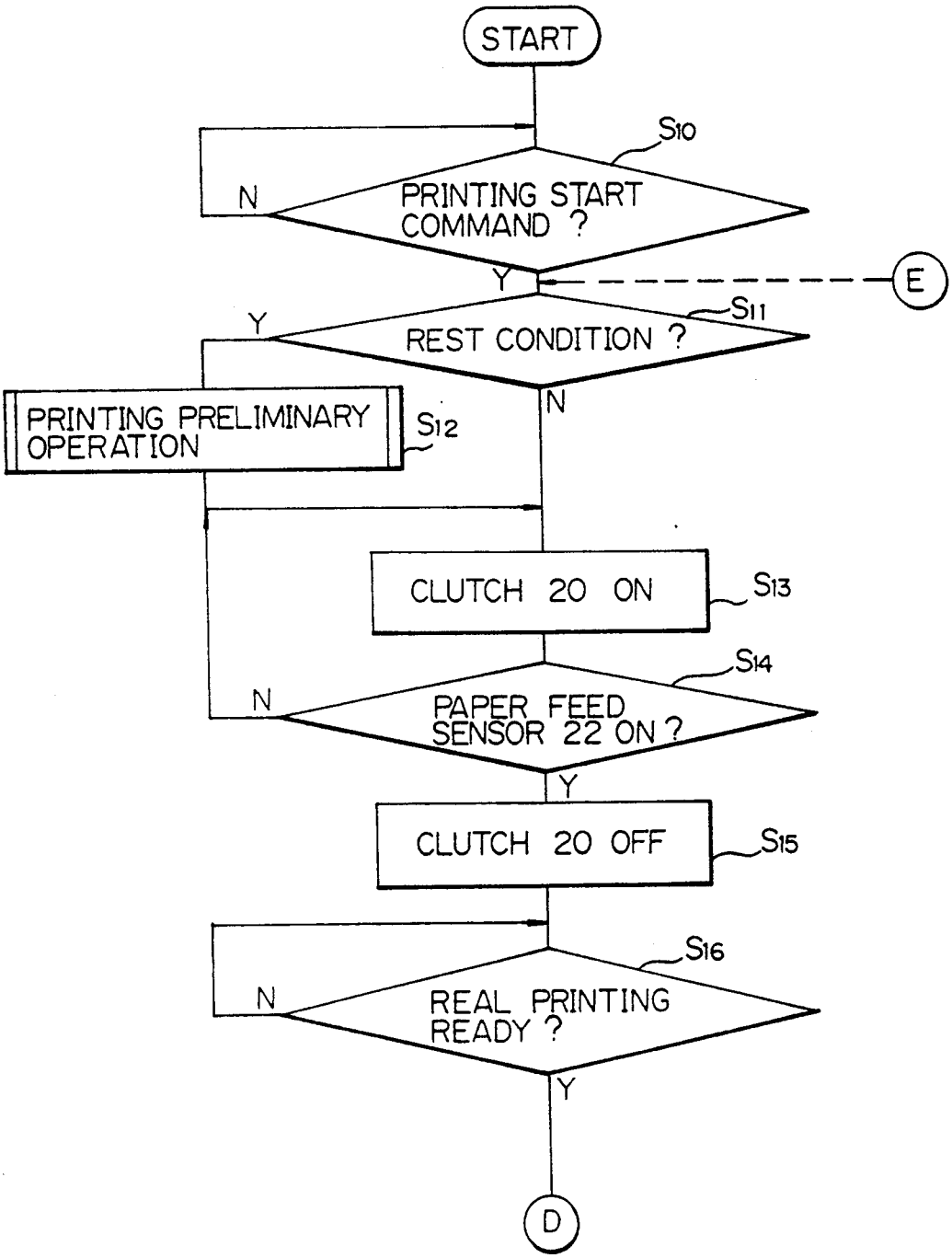
Fig. 12A PRIOR ART
FIGS. 12A and 12B show an operational flow of a printing unit of the conventional image forming apparatus.
Figure 12B:
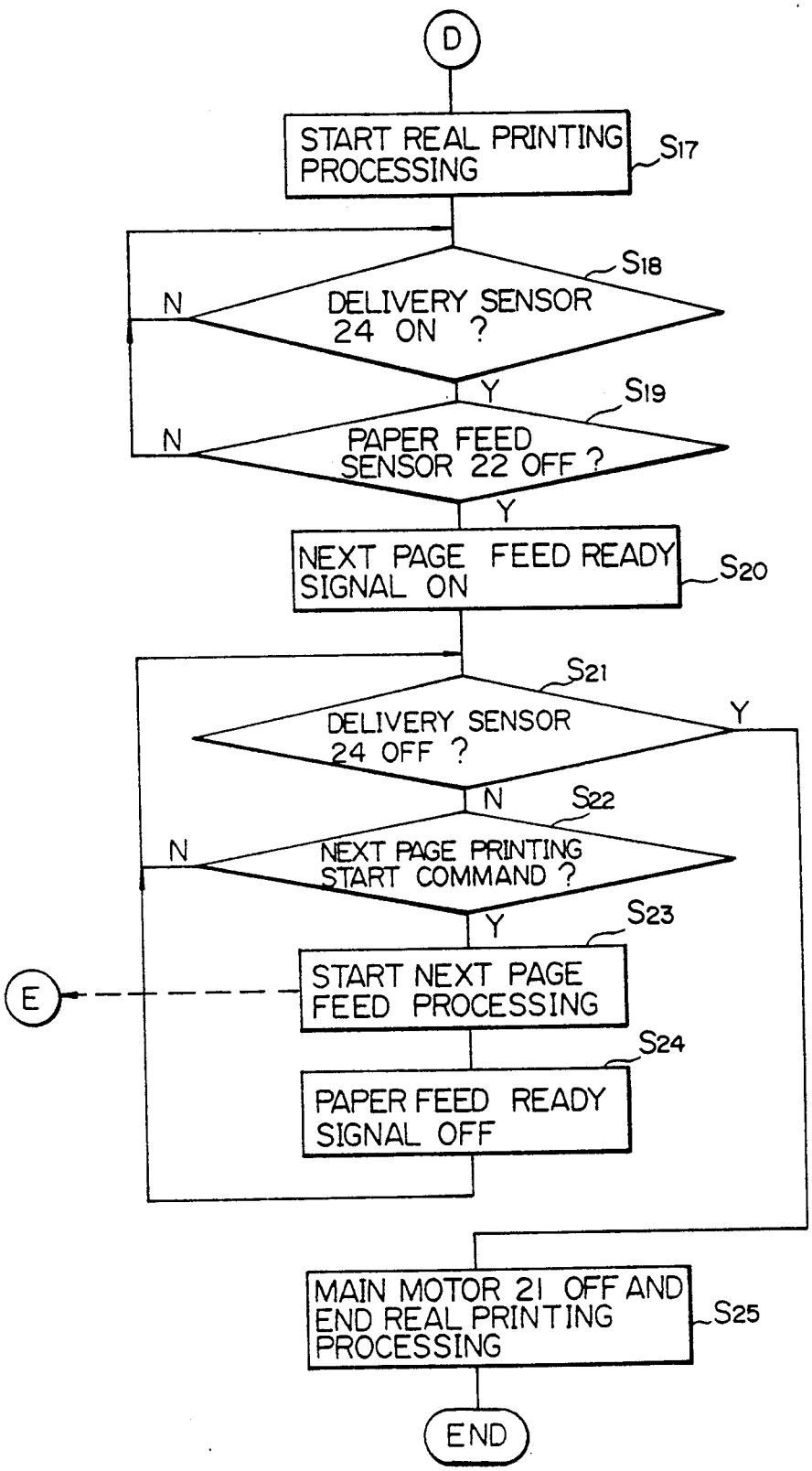
Fig. 12B PRIOR ART

FIG. 8 shows a view used for the detailed explanation of the mechanism of the printing paper feed and transfer in the third embodiment of the present invention. In the figure, a single registering motor 33 is controlled on a switching basis for use in both the printing paper feed and transfer. If the registering motor 33 is rotated in a direction of an arrow a, a planetary gear 34 moves as depicted by a continuous line so as to transmit the power of the registering motor 33 through the planetary gear 34 to the hopping roller 19, so that the hopping roller 19 is rotated in a direction of an arrow a. At that time, the printing paper 31 is taken out from the printing paper feed unit 18. When the printing paper 31 has arrived at the paper feed sensor 22, the printing mechanism control unit 26c stops the rotation of the registering motor 33. The printing paper 31 runs against the the registering roller 23b and stops at the place.

When the printing mechanism control unit 26c starts the real printing processing, the registering motor 33 is rotated in a direction of an arrow b. This rotation of the registering motor 33 moves the planetary gear 34 as depicted by a broken line so as to transmit a power of the registering motor 33 through the planet gear 34 to the registering roller 23b, so that the registering roller 23b is rotated in a direction of an arrow b to transfer the paper.

As stated above, according to the present invention, there is so arranged that the driving means of the printing paper feed unit, the driving means of the photoconductor drum and the developing unit, and the driving means of the fuser may be operative independently of each other on a suspension basis. This feature makes it possible to reduce an operation time for the photoconductor drum and the developing unit, to avoid shortening of the span of life thereof, and to extremely reduce the amount of the toner to be consumed.

The present invention is effective, particularly, in case of receiving of image data which takes time for receiving data from an external apparatus, for example, a host computer, and in case of a business graphics which takes time for an editing processing.

Further, the present invention is effective also in a case where a distance from the printing paper feed unit to the printing start position is long, for instance, in a case where the printing papers are fed from the printing paper feed unit which is provided on a bottom portion on an option basis, or provided out of the image forming apparatus.

Further, the present invention is effective also in a case where a distance from the transfer unit and the fuser to the delivery unit is long, particularly, in case of a face down system in which the delivery unit is provided on an upper portion of the printer unit and the printed papers are discharged turning over the printing surface of the printed paper in and be stacked sequentially, in a case where a sorter type of delivery unit is provided out of the image forming apparatus 1a on an option basis (distance to the paper output sensor is particularly long), in a case of dual printing or both-side printing on the front and back sides of the printing paper (transfer distance is particularly long, since the back side printing is carried out after the front side printing), and in a case where the image forming apparatus is coupled with a personal computer and be used on the basis of one sheet printing/one job.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An image forming apparatus comprising:

electrostatic latent image forming means for illuminating an electrically charged photoconductor drum with a light source to form an electrostatic latent image on a surface of said photoconductor drum;

developing means for providing adhesion of a toner to the electrostatic latent image to form a toner visible image;

transfer means for transferring the toner image to a printing sheet transferred from a printing sheet feed unit;

fuser means for heating and fusing the transferred toner image onto the printing sheet;

printing sheet feeder means for feeding the printing sheet and delivering a printed sheet;

printing sheet sensing means, including a printing sheet feed sensor, a platen sensor and a printed sheet output sensor disposed at respective positions along said printing sheet feeder means, for detecting a presence or absence of the printing sheet at said respective positions;

means for driving said photoconductor drum, said fuser means and said printing sheet feeder means, said means for driving including a common driving motor for at least said photoconductor drum and said fuser means, and coupling means, including respective clutches for at least said photoconductor drum and said fuser means, for selectively coupling said common driving motor to a respective rotary member of at least said photoconductor drum and of said fuser means when the respective clutch is engaged; and control means, responsive to output signals from said printing sheet sensing means in accordance with a sensed position of the printing sheet, for selectively controlling engagement and disengagement of the respective said clutches to cause at least said photoconductor drum and said fuser means to operate independently of each other.

2. An apparatus according to claim 1, wherein said printing sheet feed sensor is provided between a printing sheet feed unit and a registering roller, and said control means controls the respective said clutch to cause said photoconductor drum to start rotation when said printing sheet feed sensor detects the presence of the printing sheet.

3. An apparatus according to claim 1, wherein said platen sensor is provided between said transfer means and said fuser means, and said control means controls the respective said clutch to cause said fuser means to start operation when said platen sensor detects the presence of the printing sheet.

4. An apparatus according to claim 2, wherein said platen sensor is provided between said transfer means and said fuser means, and said control means controls the respective said clutch to cause said photoconductor drum to stop rotation when said platen sensor is turned off upon detecting the absence of the printing sheet.

5. An apparatus according to claim 2 wherein said platen sensor is provided between said transfer means and said fuser means, and said control means controls the respective said clutch so that said fuser means starts rotation when said platen sensor is turned on by its detection of the presence of the printing sheet.

6. An apparatus according to claim 5 wherein said printed sheet output sensor is provided between said fuser means and a delivery roller of said printing sheet feeder means; and said control means controls the respective ones of said clutches so that said photoconductor drum stops rotation when said platen sensor is turned off by detection of the absence of the printing sheet, and said fuser means stops rotation when said printed sheet output sensor is turned off upon detecting a trailing edge of a printed sheet.

7. An image forming apparatus comprising:

a rotatably mounted photoconductor drum coupled with a respective clutch;

electrostatic latent image forming means for illuminating said photoconductor drum with a light source having a plurality of light emitting diodes to form an electrostatic latent image, in accordance with a page of printing data received from a microprocessor, on a photoconductive surface of said photoconductor drum which has been electrically charged by an electrostatic charger;

developer means for developing the electrostatic latent image formed on said electrically charged photoconductor drum by adherence of a toner, charged with a frictional electrostatic charge, to form a toner visible image;

transfer means for transferring the toner image to a printing sheet of paper transferred from a printing sheet feeding unit by a hopping roller having a hopping roller clutch connected thereto;

fuser means, including a fuser roller coupled with a respective clutch, for heating and fusing the transferred toner image onto the printing sheet;

printing sheet feeder means, having a registering roller and a delivery roller each coupled with a clutch, for feeding the printer sheet and delivering a printed sheet;

printing sheet sensing means, including a printing sheet feed sensor, a platen sensor and a printed sheet output sensor disposed at respective positions along said printing sheet feeder means, for detecting a presence or absence of the printing sheet at said respective positions;

driving means for driving said photoconductor drum, said fuser means and said printing sheet feeder means, said driving means including a common driving motor for at least said photoconductor drum and said fuser means, and coupling means, including said clutches for at least said photoconductor drum and said fuser means and power transmission means, for independently transmitting driving power from said common driving motor to at least said photoconductor drum and said fuser means when the respective said clutches are engaged in accordance with detections by said sensors of said printing sheet sensing means; and control means, responsive to output signals from said sensors of said printing sheet sensing means in accordance with the sensed position of the printing sheet, for independently controlling said clutches of said coupling means so that the driving power of said common driving motor is transmitted selectively to at least said photoconductor drum and said fuser means.

8. An apparatus according to claim 7, wherein said printing sheet feed sensor is provided between said printing sheet feeding unit and said registering roller, and said control means provides such a control that said photoconductor drum starts rotation by being connected to said power transmission means through the respective said clutch when said printing sheet feed sensor is turned on upon detecting presence of the printing sheet.

9. An apparatus according to claim 7, wherein said platen sensor is provided between said transfer means and said fuser means, and said control means provides such control that said fuser means starts rotation when said platen sensor is turned on upon detecting the presence of the printing sheet.

10. An apparatus according to claim 7, wherein: said printing sheet feed sensor is provided between printing sheet feeding unit and said registering roller; said platen sensor is provided between said transfer means and said fuser means; and said control means provides such control that said photoconductor drum starts rotation by being connected to said power transmission means through the respective said clutch when said printing sheet feed sensor is turned on upon detecting the presence of the printing sheet, and stops rotation when said platen sensor is turned off upon detecting a trailing edge of the printing sheet.

11. An apparatus according to claim 7, wherein: said platen sensor is provided between said transfer means and said fuser means; said printed sheet output sensor is provided between said fuser means and said delivery roller; and said control means provides such control that said fuser means starts rotation when said platen sensor detects the presence of the printing sheet, and stops rotation when said printed sheet output sensor detects a trailing edge of a printed sheet.

12. An apparatus according to claim 8, wherein said platen sensor is provided between said transfer means and said fuser means, and said control means provides such control that said fuser means starts rotation when said platen sensor is turned on upon detecting the presence of the printing sheet.

13. An apparatus according to claim 12, wherein said control means provides such control that said photoconductor drum stops rotation when said platen sensor subsequently is turned off upon detecting the absence of the printing sheet.

14. An apparatus according to claim 13, wherein said printed sheet output sensor is provided between said fuser means and said delivery roller of said printing sheet feeder means, and said control means provides such control that said fuser means stops rotation when said printed sheet output sensor is turned off upon detecting a trailing edge of the printed sheet.

15. An apparatus according to claim 7, wherein said common driving motor comprises a stepping motor.

16. An image forming apparatus according to claim 7 wherein said printing sheet feeder means includes said hopping roller, said registering roller and said delivery roller.

17. An apparatus according to claim 7, wherein said coupling means are responsive to signals applied thereto by said control means to start the operation of said photoconductor drum and said fuser means independently in timing, respectively.

18. An apparatus according to claim 7 wherein said coupling means are responsive to signals applied thereto by said control means to stop the operation of said photoconductor drum and said fuser means independently in timing, respectively.

19. An apparatus according to claim 7 wherein: said platen sensor is located between said transfer means and said fuser means; said printed sheet output sensor is located between said fuser means and a delivery roller; and said control means controls the respective said clutch for said fuser means to cause said fuser means to start rotation when said platen sensor detects the presence of a printing sheet and to stop rotation of said fuser means when said printed sheet output sensor subsequently detects the absence of the printed sheet.

20. An apparatus according to claim 14 wherein said electrostatic image forming means forms the electrostatic image on a basis of dot image data; wherein said control means receives the printing data from the microcomputer and forms dot image data by editing the received printing data; and wherein said control means controls: said common driving motor to start rotation and said clutch of said hopping roller to engage when receipt of the printing data is started; said clutch of said hopping roller to disengage and said clutch of said photoconductor drum to engage when said printing sheet feed sensor turns on; the start of the editing of a first page of the received printing data when the receipt of the printing data is completed, said clutch of said registering roller to engage when the editing of the first page of the printing data is completed, and said clutch of said registering roller to disengage when said printing sheet feed sensor turns off.

* * * * *